US009572475B2

(12) United States Patent
Gephart et al.

(10) Patent No.: US 9,572,475 B2
(45) Date of Patent: Feb. 21, 2017

(54) APPLIANCE WITH CLOSURE ELEMENT HAVING AN OPERATIVE DEVICE

(71) Applicant: Whirlpool Corporation, Benton Harbor, MI (US)

(72) Inventors: Jonathan D. Gephart, Saint Joseph, MI (US); Andrew T. Middleton, Spring, TX (US); Blayne C. Smith, Saint Joseph, MI (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 339 days.

(21) Appl. No.: 13/872,182

(22) Filed: Apr. 29, 2013

(65) Prior Publication Data

US 2014/0319990 A1 Oct. 30, 2014

(51) Int. Cl.

| | |
|---|---|
| ***A47B 88/00*** | (2006.01) |
| ***A47B 96/04*** | (2006.01) |
| ***A47L 15/00*** | (2006.01) |
| ***F25D 23/02*** | (2006.01) |
| ***F25D 25/02*** | (2006.01) |
| ***A47L 15/42*** | (2006.01) |
| *F25D 29/00* | (2006.01) |

(52) U.S. Cl.

CPC ..... *A47L 15/0084* (2013.01); *A47L 15/4257* (2013.01); *F25D 23/021* (2013.01); *F25D 25/025* (2013.01); *F25D 29/005* (2013.01); *F25D 2400/40* (2013.01)

(58) Field of Classification Search

CPC ... A47L 15/0084; H05K 5/0247; E05D 15/00; F25D 23/028; F25D 23/021; F25D 25/025; F25D 2400/40; F25D 29/005

USPC ..... 312/223.6, 330.1, 402, 401, 405, 319.3,312/319.4, 291, 292

See application file for complete search history.

(56) References Cited

U.S. PATENT DOCUMENTS

| | | | | |
|---|---|---|---|---|
| 892,187 A | | 6/1908 | Schriefer | |
| 909,547 A | * | 1/1909 | Clark | 108/50.02 |
| 2,214,759 A | * | 9/1940 | Bosch, Jr. | 242/388.9 |
| 2,815,018 A | | 12/1957 | Collins | |
| 3,131,981 A | | 5/1964 | Scott et al. | |

(Continued)

FOREIGN PATENT DOCUMENTS

| | | |
|---|---|---|
| CN | 2327965 Y | 7/1999 |
| DE | 1980332 U | 3/1968 |

(Continued)

OTHER PUBLICATIONS

European Search Report for Counterpart EP12194115.7, Mar. 28, 2013.

*Primary Examiner* — Daniel J Troy
*Assistant Examiner* — Timothy M Ayres

(57) ABSTRACT

An appliance that conducts a useful cycle of operation on an article comprises a treating chamber receiving the article and having an access opening. A first closure element selectively closes at least a first portion of the access opening, and a second closure element movable relative to the first closure element selectively closes at least a second portion of the access opening. An operative device can be coupled to the second closure element. A cable providing at least one of electrical or data communication to the device is routed through the first closure element to the second closure element and is operatively connected to the device on the second closure element.

14 Claims, 18 Drawing Sheets

(56) References Cited

U.S. PATENT DOCUMENTS

| | | | | |
|---|---|---|---|---|
| 3,143,638 | A | 8/1964 | Scott | |
| 3,176,118 | A | 3/1965 | Scott | |
| 3,430,638 | A | 3/1969 | Brollo | |
| 3,498,285 | A | 3/1970 | McArthur, Jr. et al. | |
| 4,149,518 | A | 4/1979 | Schmidt et al. | |
| 4,271,892 | A | 6/1981 | Brusseau et al. | |
| 4,875,745 | A | 10/1989 | Trulaske | |
| 5,470,142 | A | 11/1995 | Sargeant et al. | |
| 5,618,458 | A | 4/1997 | Thomas | |
| 5,651,380 | A | 7/1997 | Sargeant et al. | |
| 5,651,382 | A | 7/1997 | Sargeant et al. | |
| 5,709,237 | A | 1/1998 | Sargeant et al. | |
| 5,743,281 | A | 4/1998 | Sargeant et al. | |
| 5,755,244 | A | 5/1998 | Sargeant et al. | |
| 5,787,724 | A * | 8/1998 | Pohl | B67D 1/0858 16/386 |
| 6,189,551 | B1 | 2/2001 | Sargeant et al. | |
| 6,244,277 | B1 | 6/2001 | Maunsell | |
| 6,294,767 | B1 | 9/2001 | Sargeant et al. | |
| 6,398,495 | B1 | 6/2002 | Kazianus | |
| 6,409,517 | B2 * | 6/2002 | Malnati | 439/38 |
| 6,447,081 | B1 | 9/2002 | Sargeant et al. | |
| 6,517,365 | B1 * | 2/2003 | Bungo et al. | 439/162 |
| 6,719,383 | B2 * | 4/2004 | Elick | A47L 15/4257 312/228 |
| 6,996,967 | B2 * | 2/2006 | Kobayashi | 59/78.1 |
| 7,640,866 | B1 * | 1/2010 | Schermerhorn | 108/50.02 |
| 7,775,223 | B2 | 8/2010 | Gunnerson et al. | |
| 8,106,539 | B2 | 1/2012 | Schatz et al. | |
| 2002/0088502 | A1 | 7/2002 | Van Rompuy et al. | |
| 2002/0171335 | A1 * | 11/2002 | Held | 312/223.6 |
| 2003/0230956 | A1 | 12/2003 | Flowers et al. | |
| 2006/0087207 | A1 * | 4/2006 | Oh et al. | 312/402 |
| 2006/0087208 | A1 * | 4/2006 | Oh et al. | 312/402 |
| 2007/0108777 | A1 | 5/2007 | Mueller et al. | |
| 2007/0246090 | A1 | 10/2007 | Anderson et al. | |
| 2008/0315735 | A1 | 12/2008 | Fabbro et al. | |
| 2009/0118848 | A1 | 5/2009 | Santinato et al. | |
| 2009/0301312 | A1 | 12/2009 | Iwamoto et al. | |
| 2011/0050065 | A1 | 3/2011 | Lee et al. | |
| 2011/0057460 | A1 | 3/2011 | Onofrio | |
| 2011/0121660 | A1 | 5/2011 | Azancot et al. | |
| 2011/0146333 | A1 | 6/2011 | Koo et al. | |
| 2011/0181163 | A1 | 7/2011 | Han et al. | |
| 2012/0043871 | A1 | 2/2012 | Jerg et al. | |
| 2012/0161594 | A1 | 6/2012 | Kim et al. | |
| 2012/0187811 | A1 | 7/2012 | Kim et al. | |
| 2012/0217851 | A1 | 8/2012 | Bae et al. | |

FOREIGN PATENT DOCUMENTS

| | | | |
|---|---|---|---|
| DE | 3922839 | A1 | 1/1991 |
| DE | 29622066 | U1 | 4/1998 |
| EP | 1776914 | A1 | 4/2007 |
| EP | 2186463 | A1 | 5/2010 |
| EP | 2324751 | A1 | 5/2011 |
| FR | 2730912 | A1 | 8/1996 |
| JP | 10211037 | A | 8/1998 |
| JP | 11178770 | | 6/1999 |
| JP | 2000326853 | A | 11/2000 |
| JP | 2002034686 | A | 2/2002 |
| JP | 2002066189 | A | 3/2002 |
| JP | 2002238679 | A | 8/2002 |
| JP | 2003079457 | A | 3/2003 |
| JP | 3451218 | A | 9/2003 |
| JP | 2004040713 | A | 2/2004 |
| JP | 2005110901 | A | 4/2005 |
| JP | 2005270476 | A | 10/2005 |
| JP | 2006219250 | A | 8/2006 |
| JP | 2007044550 | A | 2/2007 |
| JP | 2008092985 | A | 4/2008 |
| JP | 4515126 | B2 | 7/2010 |
| JP | 2010142319 | A | 7/2010 |
| JP | 2010146780 | A | 7/2010 |
| JP | 4570975 | B2 | 10/2010 |
| JP | 4655380 | B2 | 3/2011 |
| JP | 4789375 | B2 | 10/2011 |
| KR | 1020100106686 | A | 10/2010 |
| KR | 1020110072372 | A | 6/2011 |
| KR | 1020110088360 | A | 8/2011 |
| KR | 20120097307 | A | 9/2012 |
| WO | WO 2008/119641 | | * 10/2008 |
| WO | 2009086888 | A1 | 7/2009 |
| WO | 2009123530 | A1 | 8/2009 |

* cited by examiner

APPLIANCE WITH CLOSURE ELEMENT HAVING AN OPERATIVE DEVICE

BACKGROUND

Some household appliances, such as dishwashers, refrigerators, and ovens, have multiple closure elements, such as pivoting doors and sliding drawer fronts, that selectively close chambers, such as a refrigerator chamber, a freezer chamber, a dish treating chamber, and an oven cavity. Operative devices, examples of which include user interfaces/control panels, displays, and lights, mounted to one of the closure elements can require a supply of power and/or data communication.

SUMMARY

An appliance according to one embodiment conducting a useful cycle of operation on an article comprises a treating chamber receiving the article and having an access opening, a first closure element selectively closing at least a first portion of the access opening, a second closure element selectively closing at least a second portion of the access opening and movable relative to the first closure element, an operative device coupled to the second closure element, and a cable providing at least one of electrical or data communication to the device. The cable is routed through the first closure element to the second closure element and is operatively connected to the device on the second closure element.

DESCRIPTION OF EMBODIMENTS OF THE INVENTION

Figure 1:
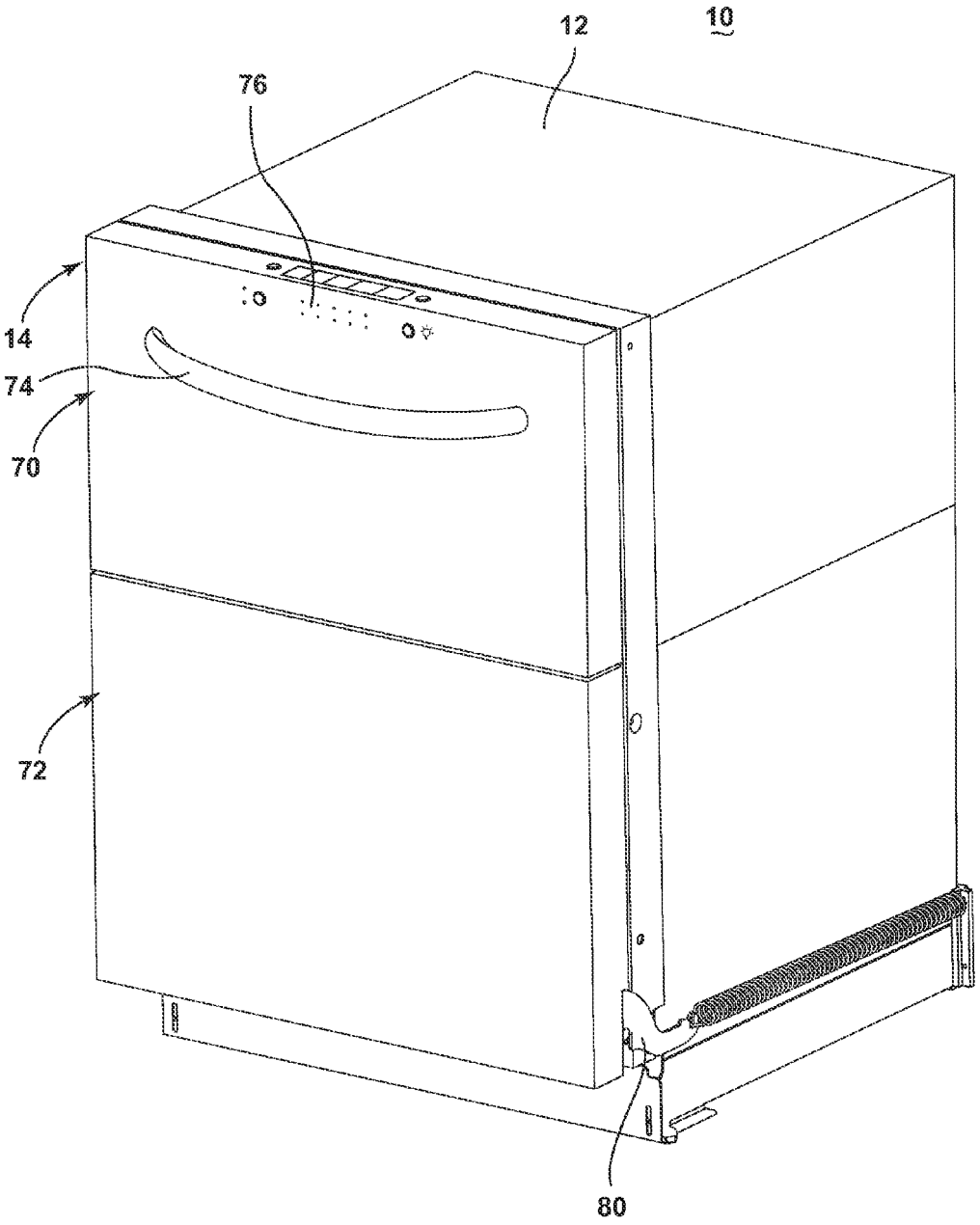
FIG. 1 is a perspective view of an appliance in the form of a multi-compartment dishwasher having a closure element system according to one embodiment in a full mode and closed condition.

FIG. 1 is a perspective view of an appliance in the form of a multi-compartment dishwasher 10 according to an embodiment of the invention. Although the actual dishwasher or other appliance into which the embodiments of the invention may be incorporated may vary, the invention is shown in connection with the dishwasher 10 for illustrative purposes. The invention may also be embodied in another type of appliance, including a refrigerator, a freezer, a refrigerator/freezer, an oven, and the like.

The dishwasher 10 includes a chassis 12 and a closure element system 14 mounted to the chassis 12. The chassis 12 may be a cabinet or a frame, with or without exterior panels. Built-in dishwashers typically have only a frame without panels, whereas stand-alone dishwashers have a frame with decorative panels covering the frame.

Figure 2:
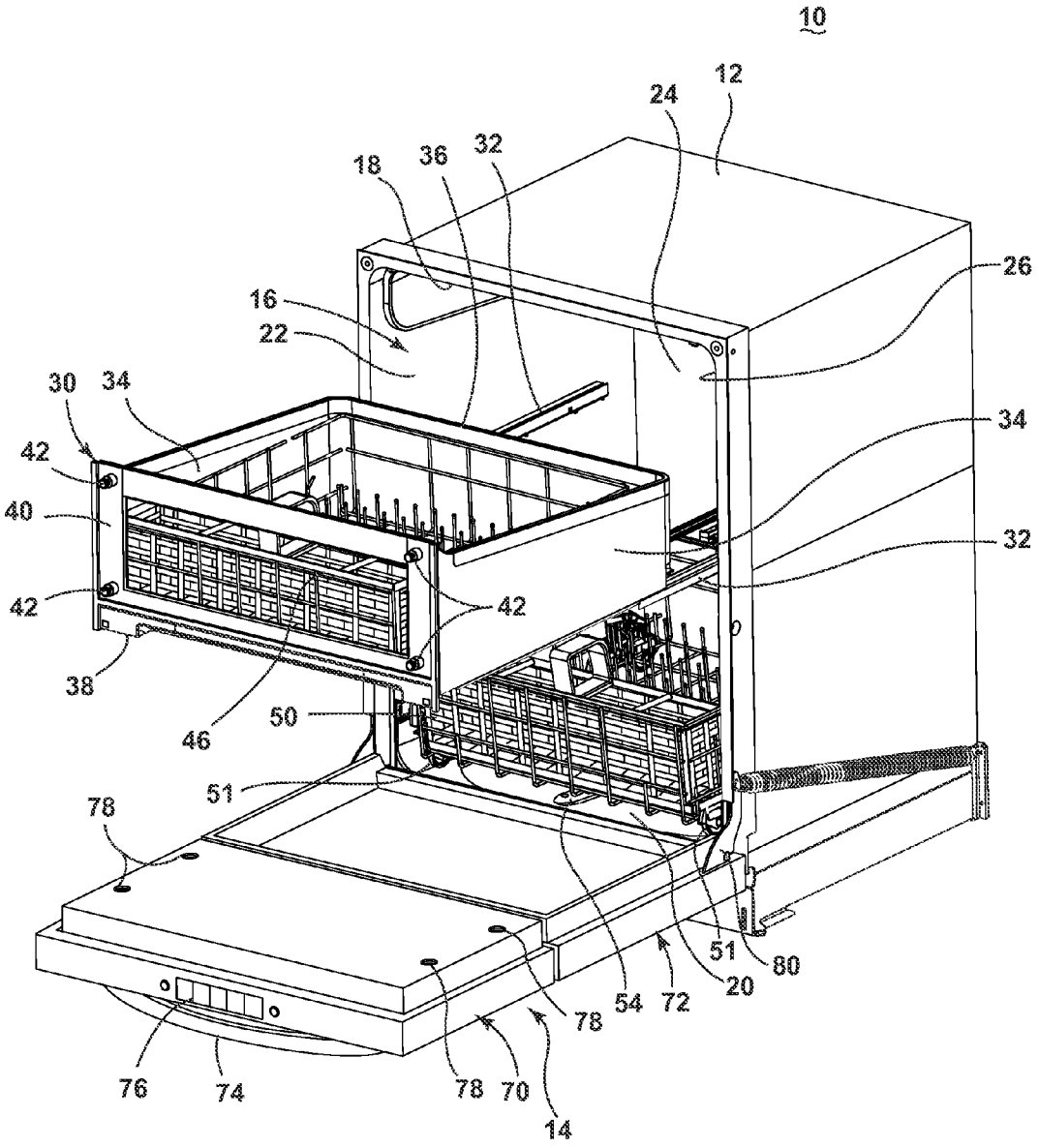
FIG. 2 is a perspective view of the dishwasher of FIG. 1 with the closure element system in an opened condition and an upper dish holder slid forward from the dishwasher.

Referring now to FIG. 2, which is a perspective view of the dishwasher 10 with the closure element system 14 in an opened position, the dishwasher 10 may comprise a tub 16 having opposing top and bottom walls 18, 20, opposing side walls 22, and a rear wall 24. The front edges of the top and bottom walls 18, 20 and the opposing side walls 22 collectively form an access opening 26 for the tub 16. The interior of the tub 16 may include any number of multiple compartments, and the illustrated embodiment features two compartments, an upper compartment and a lower compartment. The upper and lower compartments may have any relative sizing, with the upper compartment being smaller than, larger than, or the same size as the lower compartment.

Figure 3:
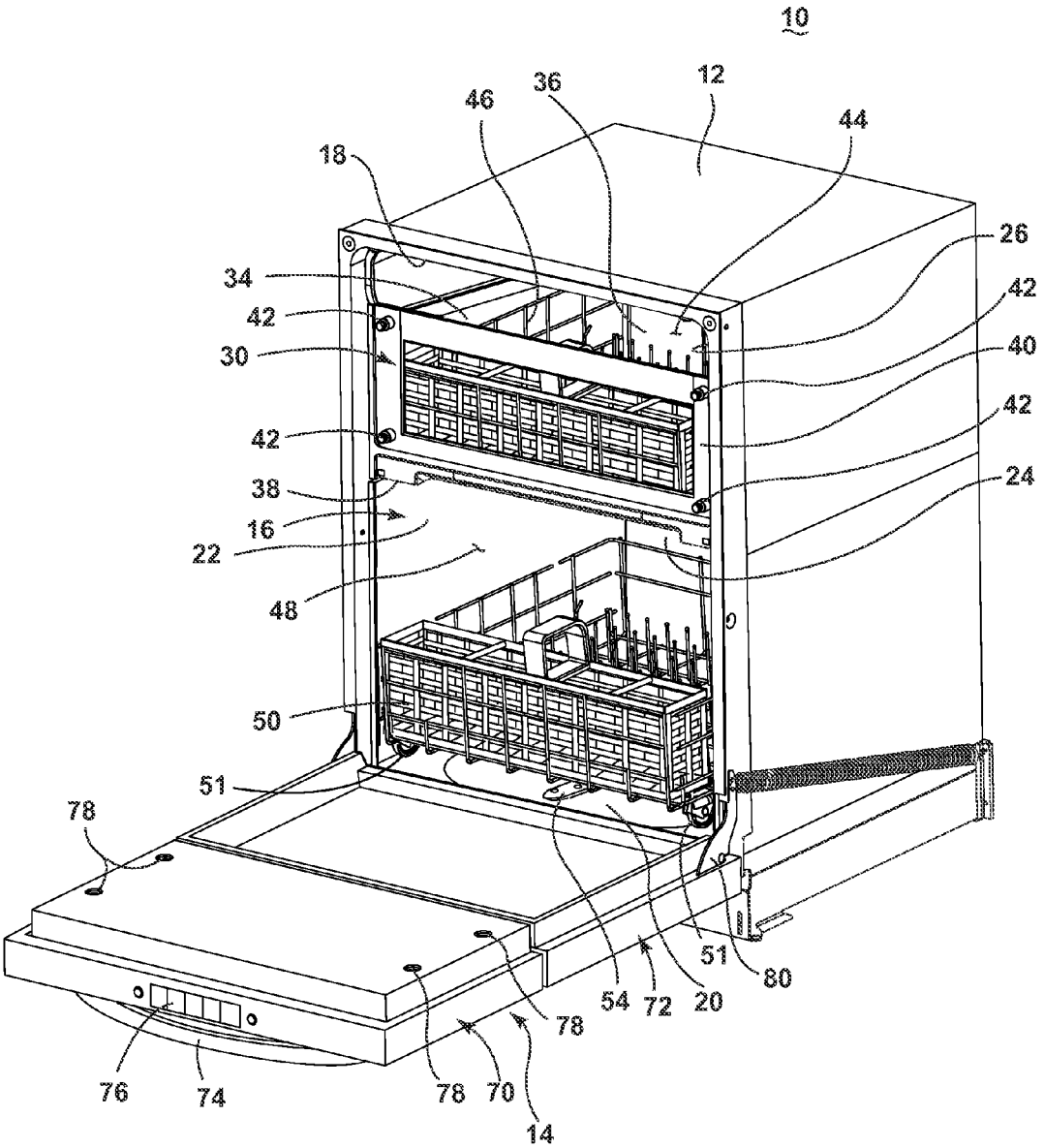
FIG. 3 is a perspective view of the dishwasher of FIG. 1 similar to FIG. 2 with the upper dish holder slid rearward into the dishwasher.

The upper compartment may be at least partially formed by a drawer 30 slidably mounted to the side walls 22 by slide rails 32. The slide rails 32 may be well-known, conventional drawer slides; alternatively, the drawer 30 may be mounted to the side walls 22 by other suitable extendible support guides or attachment devices. The drawer 30 includes opposing side walls 34 joined by a rear wall 36, a bottom wall 38, and a front wall 40 in the form of a generally rectangular frame supporting a plurality of mounting pins 42. The drawer 30 is slidably movable between an extended position when slid forward out of the tub 16, as shown in FIG. 2, and a retracted position when slid rearward into the tub 16, as shown in FIG. 3. The drawer 30 and the portion of the tub 16 adjacent and above the drawer 30 may collectively define an upper treating chamber 44 for the upper compartment. The drawer 30 may be provided with a dish holder 46 for supporting various objects, such as dishes and the like, to be exposed to a treating operation in the upper treating chamber 44. As used in this description, the term "dish(es)" is intended to be generic to any item, single or plural, that may be treated in the dishwasher 10, including, without limitation, dishes, dishes, plates, pots, bowls, pans, glassware, and silverware.

The lower compartment may be collectively formed by the underside of the drawer 30 and the portion of the tub 16 below the drawer 30 to define a lower treating chamber 48. Alternatively, the dishwasher 10 may include a partition, such as a wall, below the drawer 30 to physically separate the tub 16 into the upper and lower compartments rather than having the drawer 30 form the partition. A dish holder 50 for supporting various objects, such as dishes and the like, to be exposed to a treating operation may be located in the lower treating chamber 48. The holder 50 may have wheels 51 on its lower side such that the holder 50 may roll on the closure element system 14 between an extended position when slid forward out of the tub 16 and a retracted position when slid rearward into the tub 16. Alternatively, the holder 50 may be slidably mounted to the side walls 22 by slide rails. The slide rails may be well-known, conventional drawer slides or other suitable extendible support guides or attachment devices.

Figure 4:
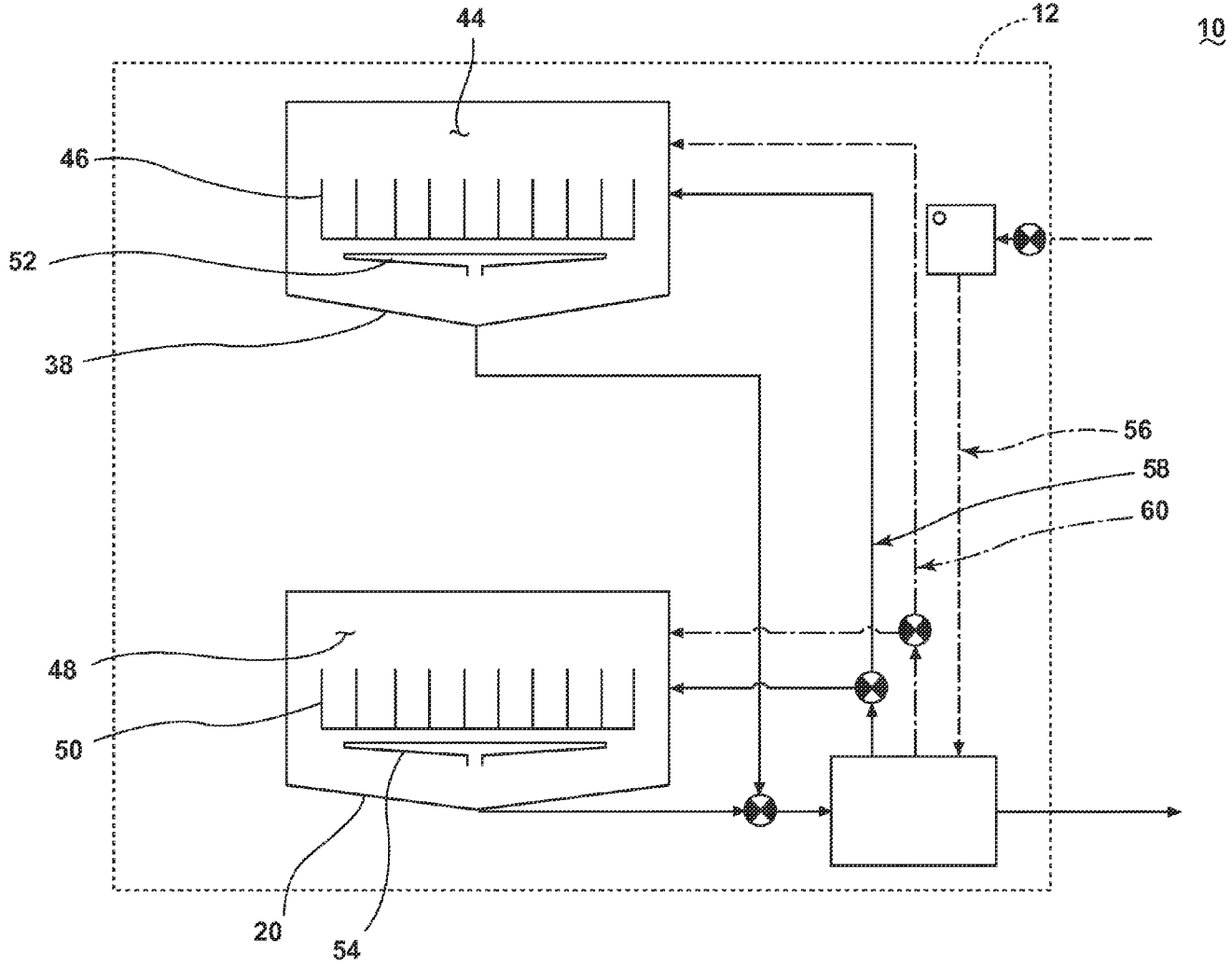
FIG. 4 is a schematic view of a liquid supply and circulation system and an air supply system for the dishwasher of FIG. 1.

Referring now to FIG. 4, a spray system may be provided for spraying liquid or a mixture of gas and liquid, including foams, hereinafter collectively referred to as liquid or fluid, within the upper and lower treating chambers 44, 48. The spray system may include a sprayer of some type for spraying liquid in each of the treating chambers 44, 48. As illustrated, sprayers 52, 54 may be located in the upper treating chamber 44 and the lower treating chamber 48, respectively, to function as fluid inlets for the upper and lower treating chambers 44, 48. The sprayers 52, 54 may comprise a traditional spray arm located below the holders 46, 50, for example, configured to rotate and generate a spray of liquid in a generally upward direction, over at least a portion of the respective upper and lower treating chambers 44, 48, typically directed to treat dishes located in the holders 46, 50. Alternatively or additionally, the sprayers 52, 54 may include other types of spray assemblies, including stationary sprayers, zone sprayers, individual spray nozzles, and the like, located at any suitable location. The type, number, and location of the sprayers 52, 54 are not germane to the present invention, and the sprayers 52, 54 need not be the same type of sprayers. The sprayers 52, 54 may function independently of each other or in concert with one another. Optionally, the bottom wall 38 of the drawer 30 and the bottom wall 20 of the tub 16 may be sloped to function as a sump or fluid outlet to drain treatment liquid from the respective upper and lower treating chambers 44, 48.

With continued reference to FIG. 4, the spray system may operatively communicate with a liquid supply system 56 (dash-dash-dot line) that supplies liquid from an external source and a liquid circulation system 58 (solid line) that supplies the liquid from the external source or recirculated liquid to the sprayers 52, 54 and receives liquid from the fluid outlet or drain in each of the upper and lower treating chambers 44, 48 to either recirculate the liquid or drain the liquid from the dishwasher 10. An exemplary liquid supply system 56 and an exemplary liquid circulation system 58 are shown and described in U.S. patent application Ser. No. 13/681,547, filed Nov. 20, 2012, which is incorporated herein by reference in its entirety. The dishwasher 10 may also include an air supply system 60 (dash-dot-dash line), an example of which is also provided in the aforementioned incorporated patent application. The liquid supply and circulation systems 56, 58 and the air supply system 60 are not germane to the invention; any suitable systems capable of supplying, delivering, recirculating, and draining liquid and any suitable system for supplying and delivering air may be employed with the dishwasher 10.

Referring back to FIG. 1, the closure element system 14 of the dishwasher may have an upper closure element 70 and a lower closure element 72 and may be capable of transforming between a partial mode, wherein the upper closure element 70 can move independently of the lower closure element 72 for independently accessing the upper treating chamber 44, and a full mode, wherein the upper and lower closure elements 70, 72 are coupled for cooperative movement to access both of the treating chambers 44, 48. The upper closure element 70 selectively closes an upper portion of the access opening 26, and the lower closure element 72 selectively closes a lower portion of the access opening 26. While the transformation aspects of the closure element system 14 will be described briefly below, details of an exemplary transforming closure element may be found in the aforementioned and incorporated patent application.

The upper closure element 70 may be generally rectangular and include a handle 74 graspable by a user for moving the closure element system 14 relative to the chassis 12. The handle 74 shown in the figures is for illustrative purposes only; the dishwasher 10 may include any type of handle or other device for moving the closure element system 14 relative to the chassis 12 and may be mounted to any suitable part of the dishwasher 10. The upper closure element 70 may also carry an operable device, shown by example in the current embodiment in the form of a user interface 76 to facilitate communication with the user regarding operation of the dishwasher 10. The user interface 76 may include various indicators and/or selectors for communicating with the user of the dishwasher 10 and to enable the user to select the mode of the closure element system 14 and an operation treating cycle for the upper and/or lower treating chambers 44, 48, along with other features common to dishwasher user interfaces. The particular type of the user interface 76 is not germane to the invention. As seen in FIG. 2, the upper closure element 70 may further include apertures 78 on its rear face sized and positioned for receipt of the mounting pins 42 on the front wall 40 of the drawer 30.

Figure 5:
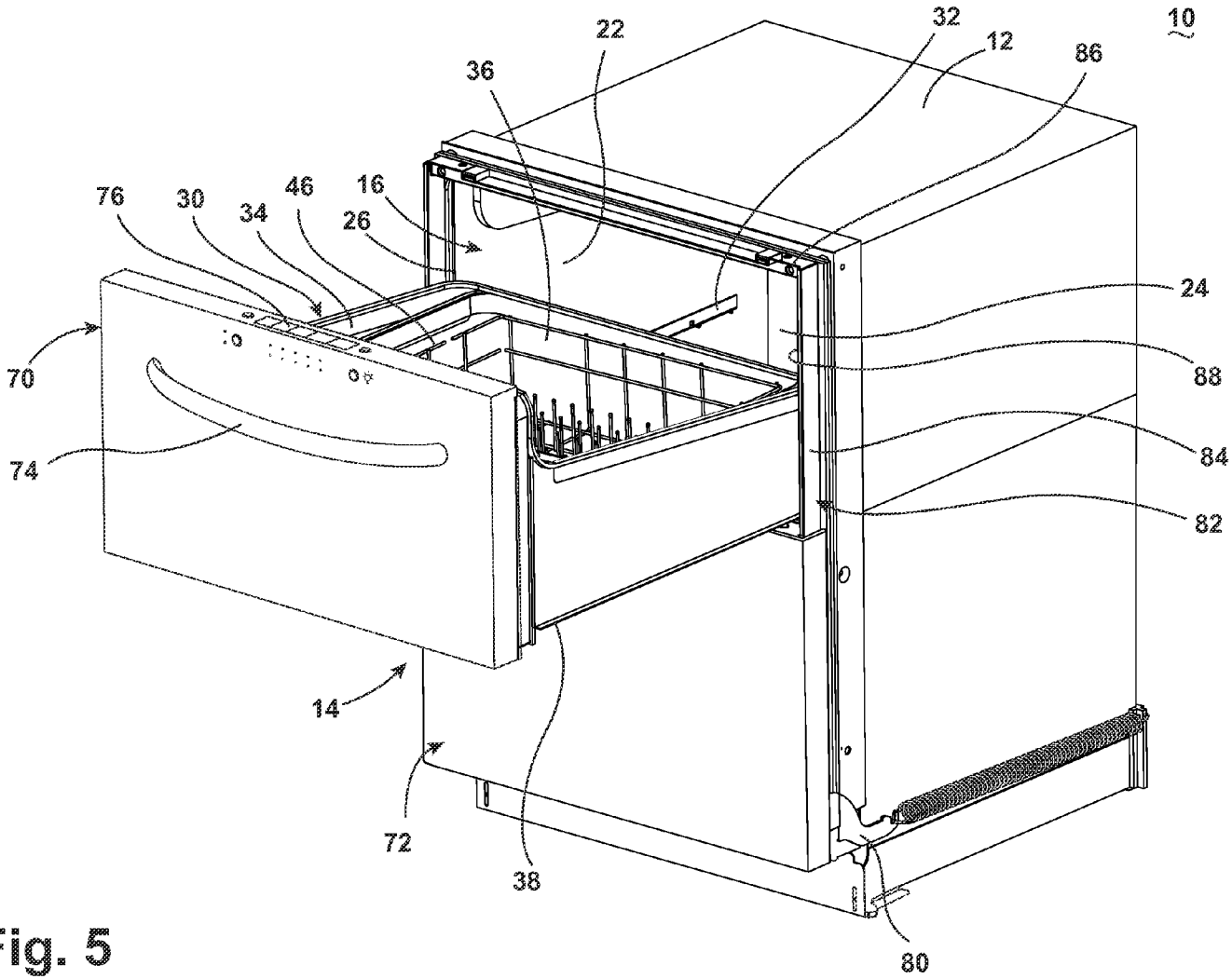
FIG. 5 is a perspective view of the dishwasher of FIG. 1 with the closure element system in a partial mode and a drawer holding the upper dish holder slid forward from the dishwasher.

With continued reference to FIG. 2, the lower closure element 72 may be generally rectangular and include a pair of hinges 80 at its lower end to pivotally mount the lower closure element 72 to the chassis 12, similar to a conventional hinged dishwasher door. Referring now to FIG. 5, a generally U-shaped frame 82 having side arms 84 connected at their upper ends by an upper arm 86 may extend upwardly from the generally rectangular portion of the lower closure element 72 and may be sized for receipt within the periphery of the upper closure element 70. The frame 82 and the upper edge of the rectangular portion of the lower door 72 may form an access opening 88 through which the drawer 30 may slide when the closure element system 14 is in the partial mode, as will be described in more detail below.

To facilitate transformation between the partial and full modes for the closure element system 14, a pair of transformation assemblies (not shown) may be positioned within the upper closure element 70 for selectively and alternatingly coupling the upper closure element 70 with the mounting pins 42 and the lower closure element 72. Exemplary transformation assemblies are described in the aforementioned and incorporated patent application. Within the upper closure element 70 and/or the lower closure element 72, a pair of actuator assemblies (not shown) may be positioned for interaction with the transformation assemblies for conversion of the closure element system 14 between the partial and full modes. Exemplary actuator assemblies are described in the aforementioned and incorporated patent application.

Conversion of the closure element system 14 between the full mode (FIGS. 2 and 3) and the partial mode (FIG. 5) may be accomplished by coupling and decoupling, respectively, the upper and lower closure elements 70, 72 while simultaneously decoupling and coupling, respectively, the upper closure element 70 and the drawer 30. In particular, actuation of the actuator assemblies for the full mode physically moves the transformation assemblies in the upper closure element 70 to physically engage the frame 82 of the lower closure element 72 to couple the lower closure element 72 to the upper closure element 70. The movement of the transformation assemblies also unlocks the mounting pins 42, received by the apertures 78 for interaction with the transformation assemblies, from the upper closure element 70 such that the upper and lower closure elements 70, 72 in a coupled condition can pivot relative to the chassis 12 about the hinges 80 without concurrent movement of the drawer 30. In this mode, the upper and lower closure elements 70, 72 selectively close the full access opening 26 such that the user can access both the upper and lower treating chambers 44, 48 when the coupled upper and lower closure elements 70, 72 are opened, as in FIGS. 2 and 3.

For conversion to the partial mode, actuation of the actuator assemblies physically moves the transformation assemblies to decouple the upper closure element 70 from the frame 82 of the lower closure element 72. The movement of the transformation assemblies also locks the mounting pins 42, received by the apertures 78 for interaction with the transformation assemblies, to the upper closure element 70 such that the upper closure element 70, uncoupled from the lower closure element 72, can slide relative to the chassis 12 and the lower closure element 72 with concurrent movement of the drawer 30, as shown in FIG. 5. In this mode, the upper closure element 70, which functions as a drawer front for the drawer 30, selectively closes the access opening 88, which is essentially coincident with an upper portion of the access opening 26, such that the user can access the upper treating chamber 44 when the upper closure element 70 is opened, as in FIG. 5.

The operative device on the upper closure element 70 may be any suitable device that requires a supply of power from a power source and/or data communication with another component of the dishwasher 10 or a device external to the dishwasher 10. In addition to the example of the user interface 76, which may include, for illustrative purposes, selectors, knobs, buttons, dials, indicator lights, and displays, including touch-screen displays, examples of the operative device include, but are not limited to, displays, such as liquid crystal display (LCD), a plasma display, and a vacuum fluorescent display (VFD), an illumination source, an actuator, a sensor, an electronic latch, and a controller.

Figure 6:
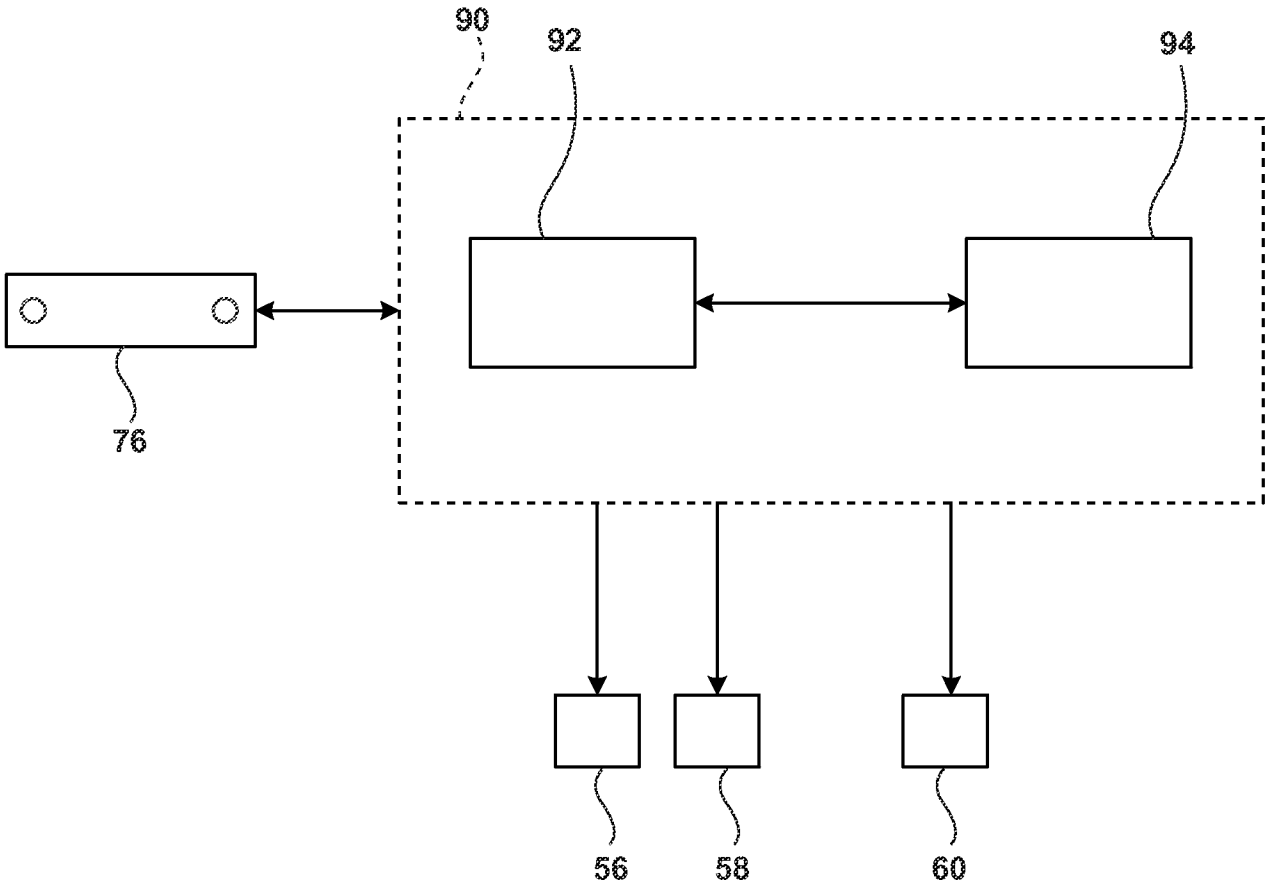
FIG. 6 is a schematic view of a controller for the dishwasher of FIG. 1.

Referring now to FIG. 6, the dishwasher 10 may also have an electronic control, shown in the illustrated embodiment as a controller 90, which can be disposed at any suitable location in the dishwasher 10, such as on the cabinet or chassis 12 or on the closure element system 14. The controller 90 may be a single controller for both the upper and lower treating chambers 44, 48 and may be operably coupled to various components of the dishwasher 10, such as the operative device, shown in the present embodiment as the user interface 76, and components of the liquid supply and circulation systems 56, 58 and of the air supply system 60, to implement a treating cycle of operation in one or both of the upper and lower treating chambers 44, 48. The controller 90 may communicate with the components of the dishwasher 10 over wired connections. The controller 90 may alternatively or additionally communicate with the components of the dishwasher 10 over a wireless communication link using a wireless communication protocol. The wireless communication link and protocol may be any type of wireless communication, including radio frequency, microwave, and infrared (IR) communications, and communications involving bit by bit, RS232, WIDE (a network protocol developed by Whirlpool, the assignee of the present patent application), I2C, etc. The controller 90 may also communicate with the user over Wi-Fi or wireless telecommunications to a portable computing device, such as a tablet computer or phone, for controlling the dishwasher 10 remotely.

The controller 90 may be provided with a memory 92 and a central processing unit (CPU) 94. The memory 92 may be used for storing control software that may be executed by the CPU 94 in completing a cycle of operation using one or both of the upper and lower treating chambers 44, 48 of the dishwasher 10 and any additional software. For example, the memory 92 may store one or more pre-programmed cycles of operation that may be selected by a user and completed by one or more of the upper and lower treating chambers 44, 48. A cycle of operation for the upper and lower treating chambers 44, 48 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of fluid and/or rinse aid used during each of the multiple rinse steps may be varied. The drying step may have a non-heated drying step (so called "air only"), a heated drying step, or a combination thereof. These multiple steps may be performed within the upper and lower treating chambers 44, 48 in any desired combination. Further, the controller 90 may execute the same or different treatment cycles started at the same or different times in the upper and lower treating chambers 44, 48.

Figure 7:
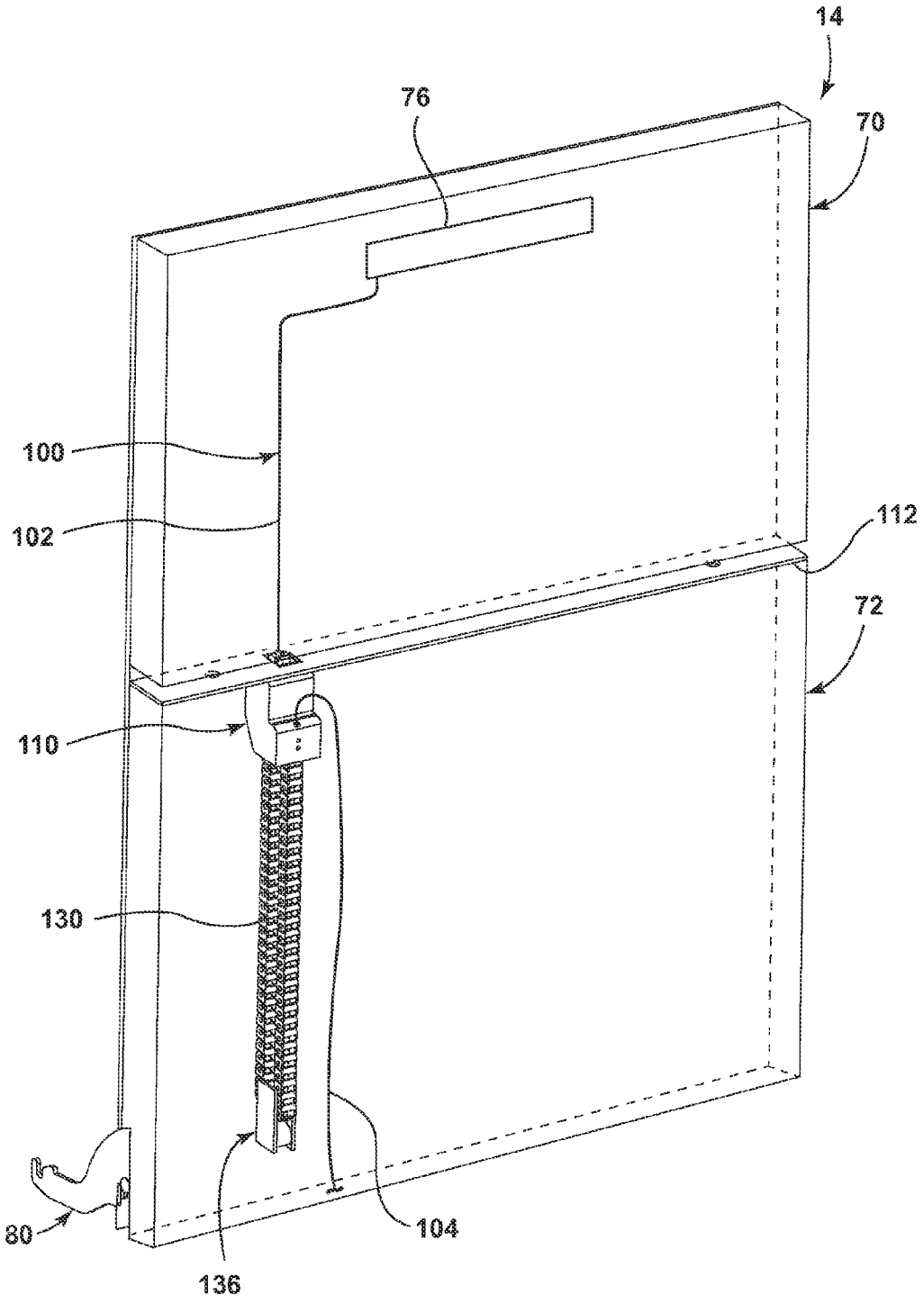
FIG. 7 is a perspective view of a wired power and/or data communication system and a cable storage system according to one embodiment for the closure element system of the dishwasher of FIG. 1.

Referring now to the schematic view of the closure element system 14 in FIG. 7, the dishwasher 10 may include a wired power and/or data communication system that provides power and/or data communication to the operative device, such as the user interface 76, on one of the closure elements, such as the upper closure element 70 in the illustrated embodiment. The system will be described as providing power and/or data communication to the user interface 76 for illustrative purposes, with it being understood that the operative device can be any suitable type of operative device and is not limited to the user interface 76.

A cable 100 that provides the power and/or data communication to the user interface 76 may have an upper cable portion 102 in the upper closure element 70 and a lower cable portion 104 in the lower closure element 72. The upper cable portion 102 may be coupled to the user interface 76 at one end and extend to a lower end of the upper closure element 70 where it exits the upper closure element 70 and joins with the lower cable portion 104. The upper and lower cable portions 102, 104 may be integrated with one another such that they are essentially a single cable, or the upper and lower cable portions 102, 104 may be distinct cables coupled together, such as by a conventional cable coupling. The lower cable portion 104 exits the lower closure element 72 at an upper end of the lower closure element 72 for joining with the upper cable portion 102 and at a lower end of the lower closure element 72 for connection to appropriate components internal to or external of the dishwasher 10 for the supply of power and/or data communication, such as the controller 90. The lower cable portion 104 may be routed through the lower end of the lower closure element 72 in a manner similar to routing of cables through a conventional hinged dishwasher door. The length of the lower cable portion 104 may be sufficiently long to extend the entire height of the door plus extra length to accommodate sliding movement of the upper closure element 70 when the closure element system 14 is in the partial mode, that is, a distance at least equal to the distance that the upper closure element 70 can move relative to the lower closure element 72.

The wired power and/or data communication system may further include a cable storage system 110 that stores at least the length of the lower cable portion 104 that accommodates the sliding movement of the upper closure element 70. As seen in FIG. 7, the illustrated embodiment of the cable storage system 110 may be located in the lower closure element 72 and mounted to the upper portion thereof by an end cap 112 disposed along the upper edge of the lower closure element 72. The end cap 112 may be planar and elongated and have a configuration similar to that of the upper edge of the lower closure element 72. A pair of mounting apertures 114 in the end cap 112 may facilitate mounting of the end cap 112 to the upper closure element 70 with suitable mechanical fasteners (not shown). Referring to the enlarged view in FIG. 8, a housing 116 may depend from the end cap 112 below a cable aperture 118 formed in the end cap 112. Further, an arcuate guide 120 may extend upward from the end cap 112 to partially overlie the cable aperture 118.

Figure 8:
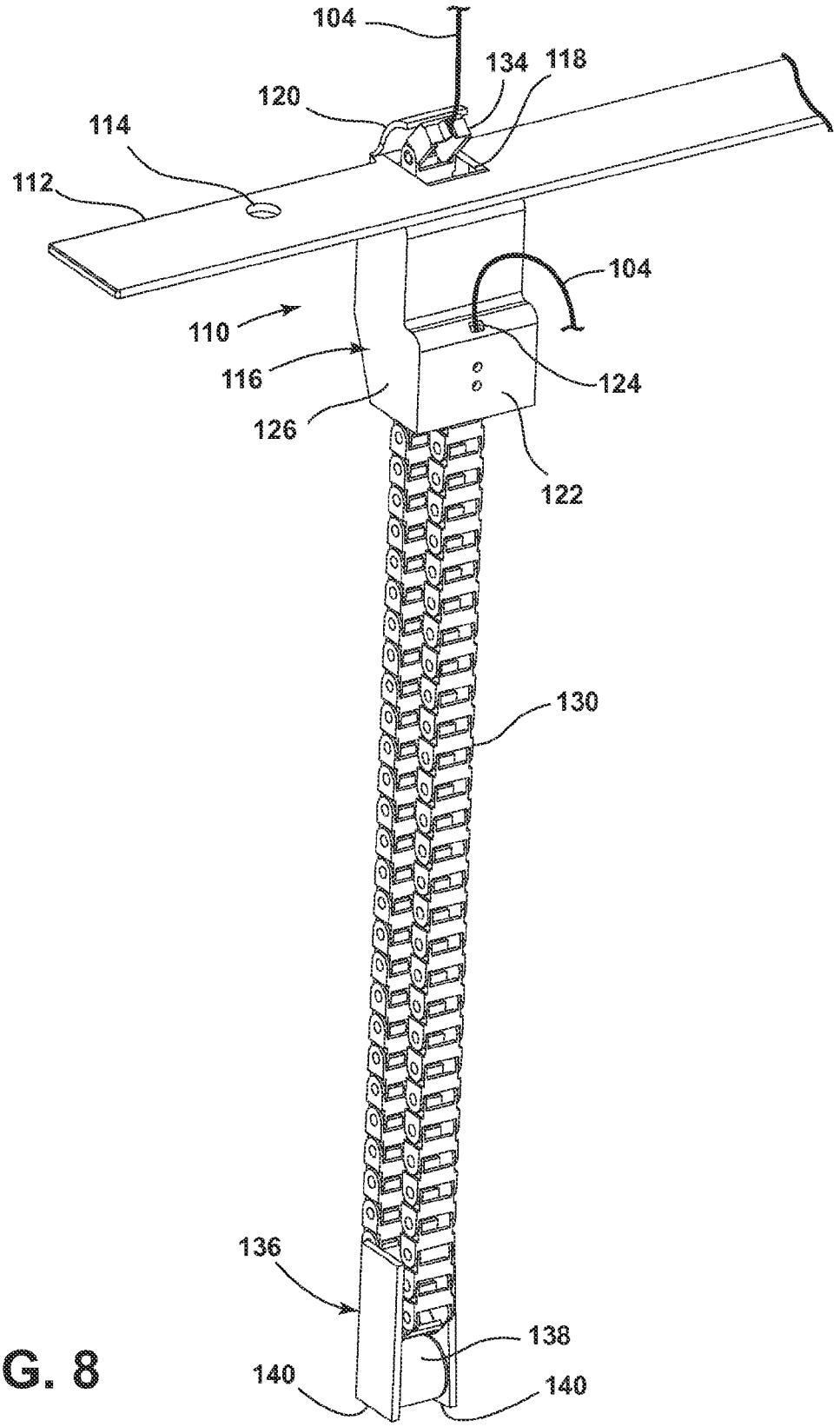
FIG. 8 is an enlarged perspective view of the cable storage system of FIG. 7.
Figure 9:
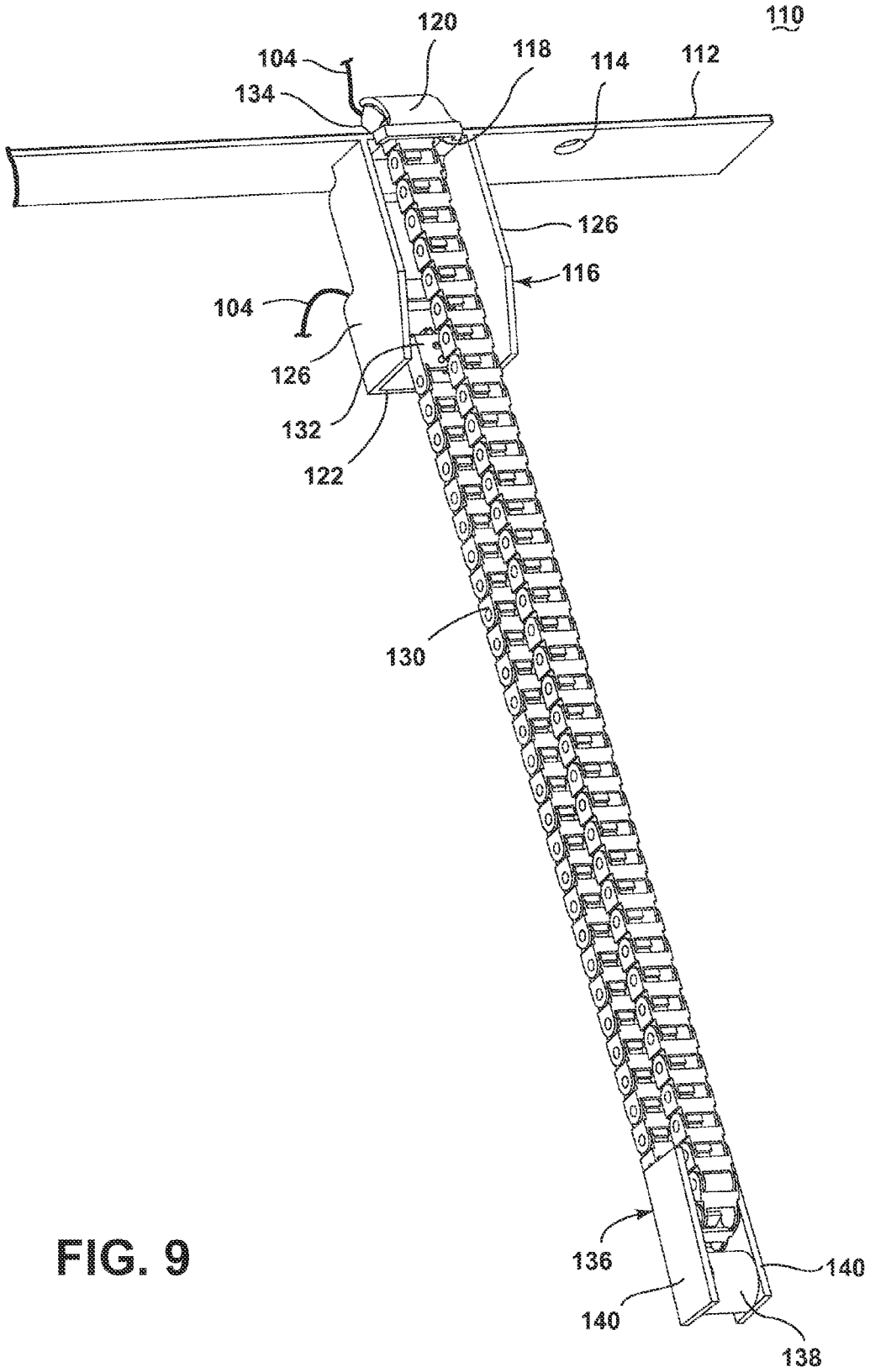
FIG. 9 is a rear perspective view of the cable storage system of FIG. 7.

The housing 116 may have a front wall 122 with a cable aperture 124, as shown in FIG. 8, and a pair of opposing side walls 126 that define an open rear and an open bottom, as best seen in the rear view of the cable storage system 110 in FIG. 9. The housing 116 supports a cable carrier 130 in the form of an articulated chain having a first end 132 mounted to the front wall 122 and a second end 134 that extends through the cable aperture 118 in the end cap 112. The cable carrier 130 in the form of the articulated chain may be formed by a plurality of interconnected links having a predetermined range of motion relative to one another. In one example, the links may be configured so that the chain is self-supporting and can retain a generally horizontal configuration without significant droop. The lower cable portion 104 may be threaded through the cable carrier 130 along the length of the cable carrier 130 and may be fixed at the first end 132 and at the second end 134 such that the cable carrier 130 moves with the lower cable portion 104, as will be explained in further detail below. The lower cable portion 104 may enter the cable storage system 110 through the cable aperture 118 in the housing 116, extend through the cable carrier 130 starting at the first end 132, and exit the cable storage system 110 at the second end 134 of the cable carrier 130 for joining with the upper cable portion 102 of the upper closure element 70 as explained above.

Figure 10:
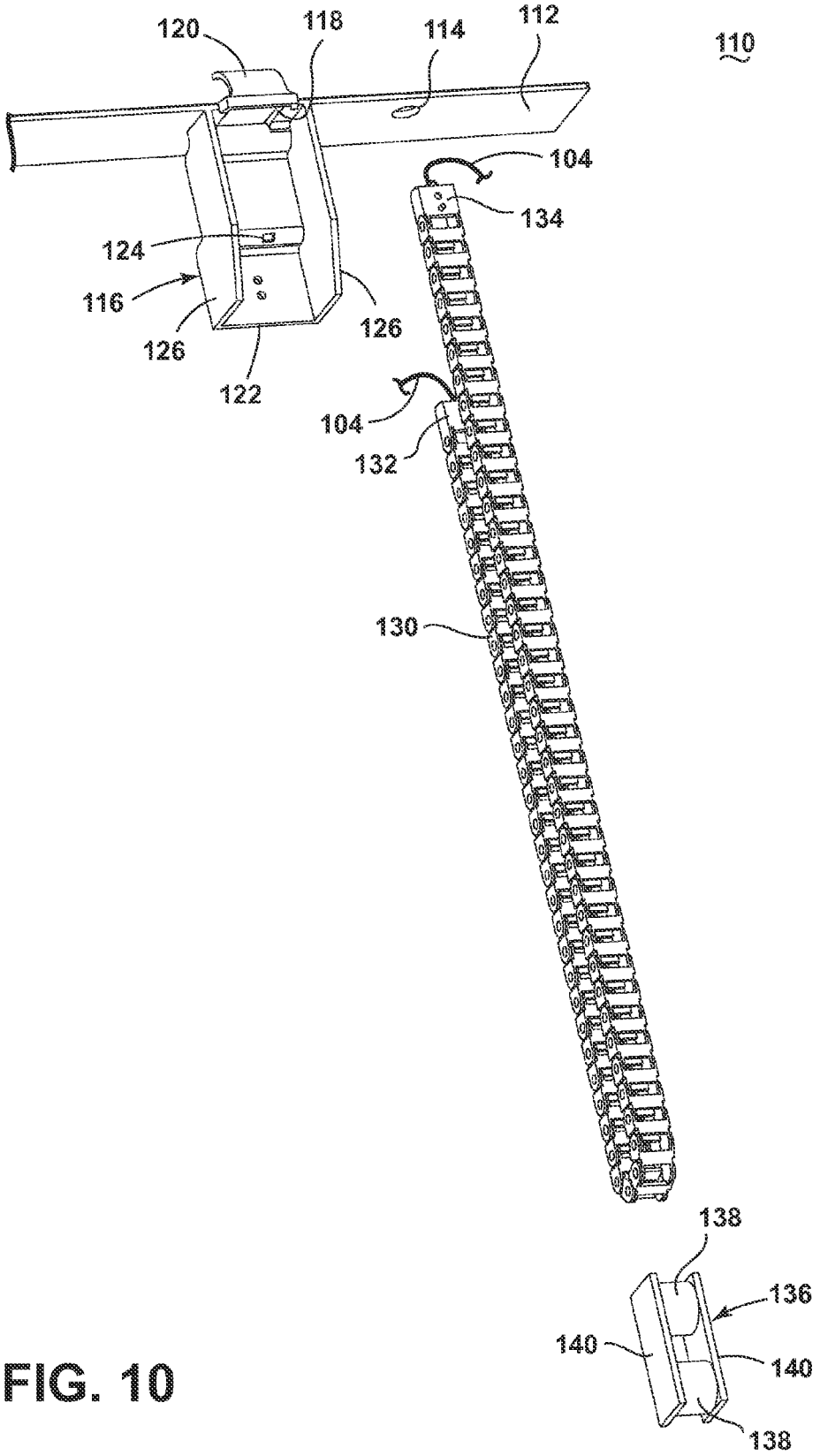
FIG. 10 is an exploded view of the cable storage system of FIG. 7.

The cable storage system 110 may optionally include a weight 136 that functions to pull the cable carrier 130 downward so that the cable carrier 130 assumes a generally vertically oriented U-shaped configuration below the housing 116. The illustrated exemplary weight 136 may comprise a pair of weighted bobbins 138 sandwiched between plates 140, as seen in the exploded view of FIG. 10, and the cable carrier 130 may extend between the bobbins 138 for coupling the weight 136 to the cable carrier 130. The weight 136 may freely hang on the cable carrier 130 such that the weight 136 may move with the cable carrier 130 as the upper closure element 70 moves relative to the lower closure element 72, as described in further detail below.

Figure 11:
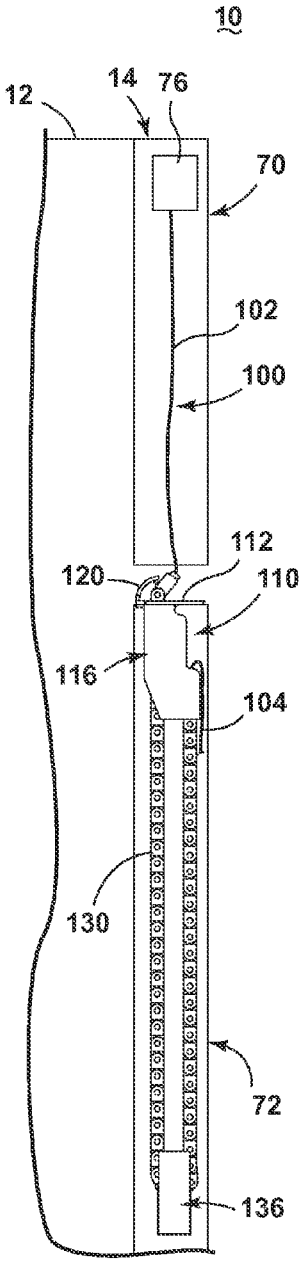
FIG. 11 is a schematic side view of the dishwasher of FIG. 1 with the closure element system in the full mode and closed condition showing the wired power and/or data communication system and the cable storage system of FIG. 7.
Figure 12:
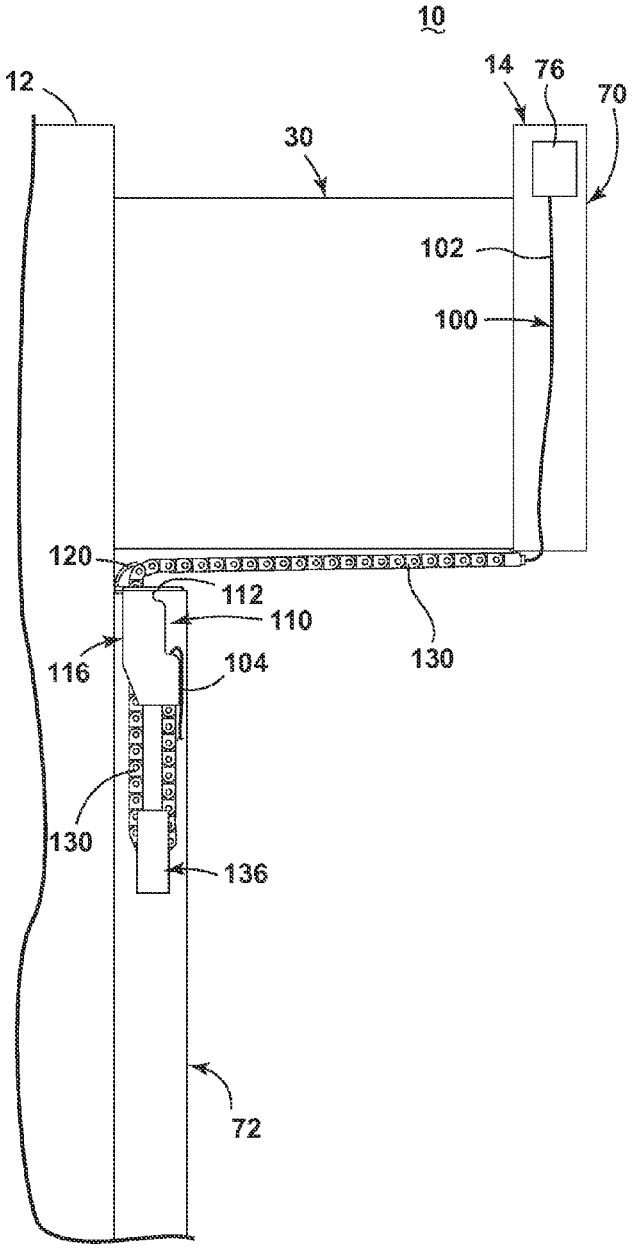
FIG. 12 is a schematic side view similar to FIG. 11 with the closure element system in the partial mode with the upper drawer slid forward of the dishwasher showing the wired power and/or data communication system and the cable storage system of FIG. 7.

The operation of the cable storage system 110 is shown schematically in FIGS. 11 and 12. When the closure element system 14 is in the full mode (or in the partial mode with the upper and lower closure elements 70, 72 vertically aligned) of FIG. 11, the lower cable portion 104 and the cable carrier 130 almost completely reside in the lower closure element 72, and the weight 136 is at its lowest position pulling the cable carrier 130 downward. When the closure element system 14 is in the partial mode, as the user slides the upper closure element 70 forward of the lower closure element 72, the cable carrier 130 and the part of the lower cable portion 104 in the cable carrier 130 move with the upper closure element 70, as depicted in FIG. 12. Particularly, the upper closure element 70 effectively pulls the lower cable portion 104 and the attached cable carrier 130 through the cable aperture 118 in the end cap 112. The cable carrier 130, with the lower cable portion 104 threaded therein, assumes a generally horizontal configuration beneath the drawer 30. As the lower cable portion 104 and the cable carrier 130 are pulled through the cable aperture 118, the length of the lower cable portion 104 and the cable carrier 130 inside the lower closure element 72 reduces, thus resulting in the cable carrier 130 raising the weight 136, which continues to apply a downward force to the cable carrier 130. When the user slides the upper closure element 70 toward the lower closure element 72 to close the drawer 30, the lower cable portion 104 and the cable carrier 130 are fed back into the lower closure element 72 through the cable aperture 118 with the guide 120 directing the links of the cable carrier 130 downward as they enter the cable aperture 118. The lower cable portion 104, the cable carrier 130, and the weight 136 return to the position shown in FIG. 11 upon complete closure of the drawer 30 with the upper closure element 70.

Figure 13:
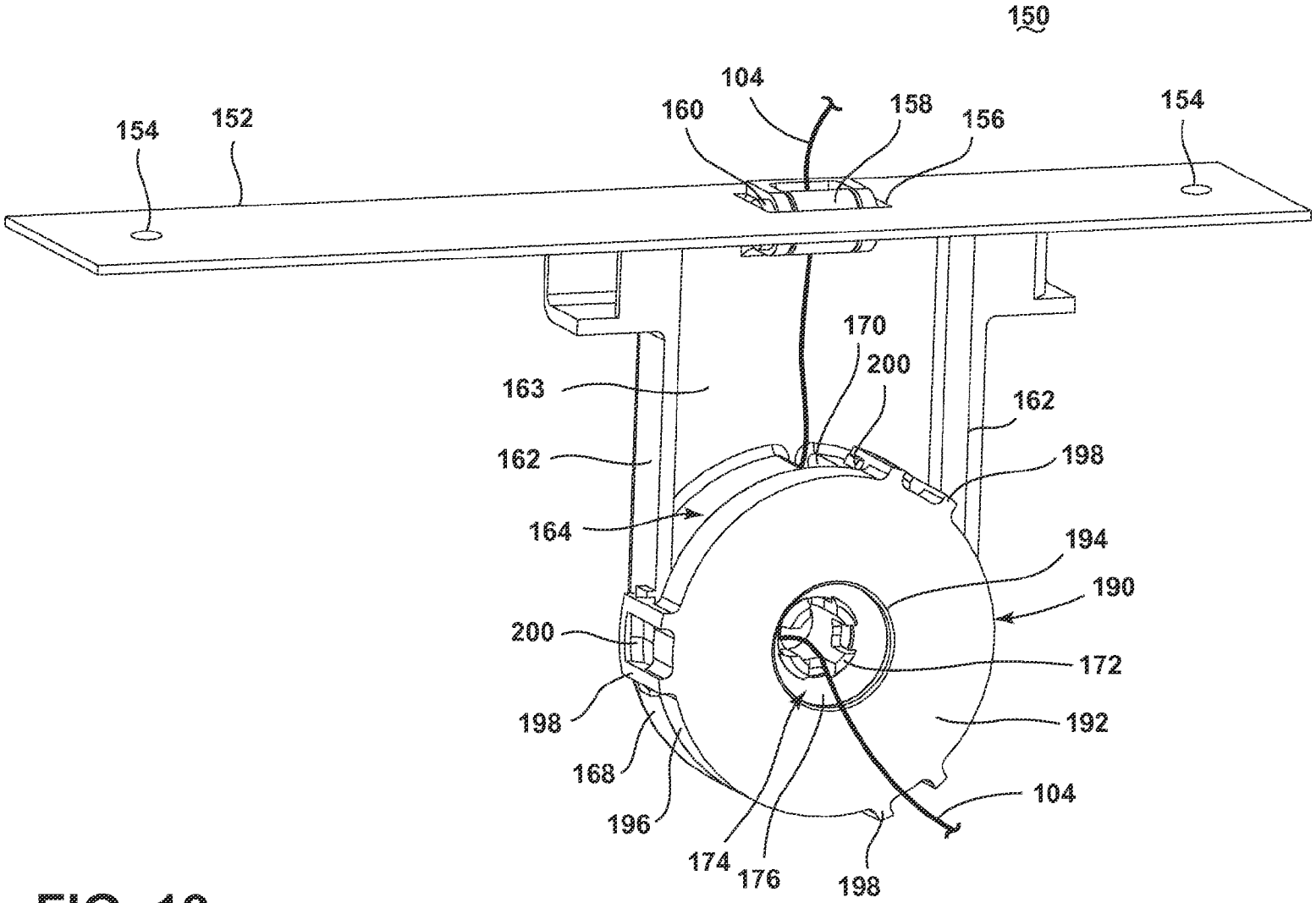
FIG. 13 is a perspective view of a cable storage system according to another embodiment.
Figure 14:
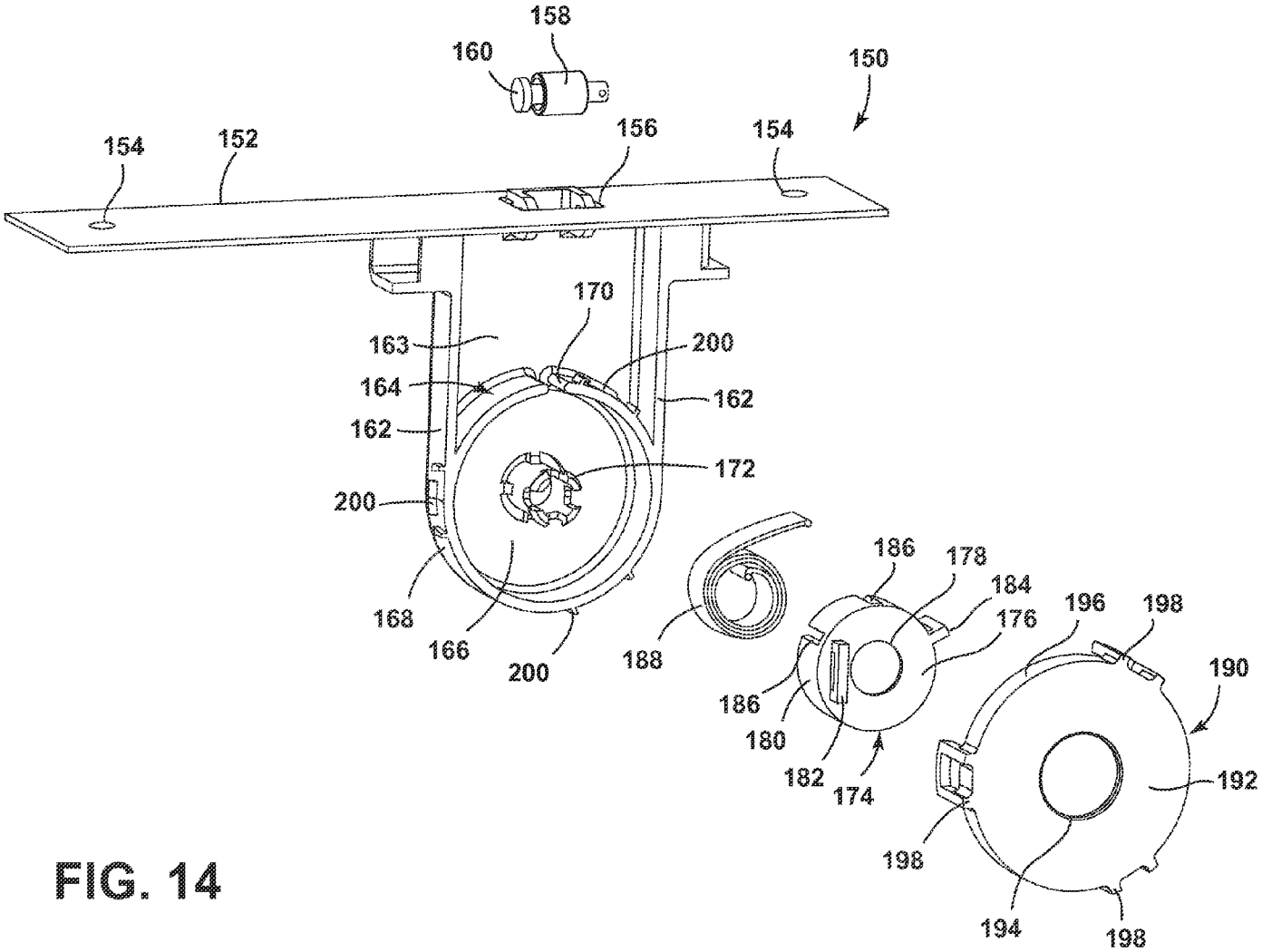
FIG. 14 is an exploded view of the cable storage system of FIG. 13.

FIG. 13 illustrates a perspective view of an alternative embodiment of a cable storage system 150 for the dishwasher 10. As with the previous embodiment cable storage system 110, the cable storage system 150 may be located in the lower closure element 72 and mounted thereto by an end cap 152 with mounting apertures 154. Further, the end cap 152 may include a cable aperture 156 within which a cylindrical roller 158 and an axle 160 for the roller 158 may be mounted. A pair of arms 162 on opposite sides of a support panel 163 may depend from the end cap 152 below the cable aperture 156 and terminate at a circular housing 164 having a rear wall 166, which can be seen in the exploded view of the cable storage system 150 of FIG. 14, and a generally circular peripheral wall 168 extending forward from the rear wall 166 and forming a slit 170 vertically aligned with the cable aperture 156. Additionally, the housing 164 may include a central barbed bushing 172 extending forwardly from the rear wall 166.

The cable storage system 150 further includes a pulley or drum 174 having a front wall 176 with a central opening 178 sized for snapping receipt on the housing barbed bushing 172 and a circular peripheral wall 180 extending rearwardly of the front wall 176. An elongated U-shaped projection 182 located on the front wall 176 stands off the front wall 176 a distance sufficient for the lower cable portion 104 (not shown in FIG. 14) to fit in the spaced defined between the projection 182 and the front wall 176. The drum 174 also includes an L-shaped projection 184 extending radially from the peripheral wall 180 that stands off the peripheral wall 180 a distance sufficient for the lower cable portion 104 (not shown in FIG. 14) to fit in the space defined between the projection 184 and the peripheral wall 180. Circumferentially spaced slits 186 formed in the peripheral wall 180 of the drum 174 facilitate mounting a biasing member 188, which is in the form of a constant force coiled spring in the illustrated embodiment, within the drum 174, as will be explained in further detail below.

An enclosure cap 190 having a generally circular front wall 192 with a central opening 194 and a rearwardly extending circular peripheral wall 196 may be sized to enclose the drum 174 within the housing 164 and may include a plurality of tabs 198 around the peripheral wall 196 adapted to mate with corresponding tab receivers 200 on the housing 164.

Figure 15:
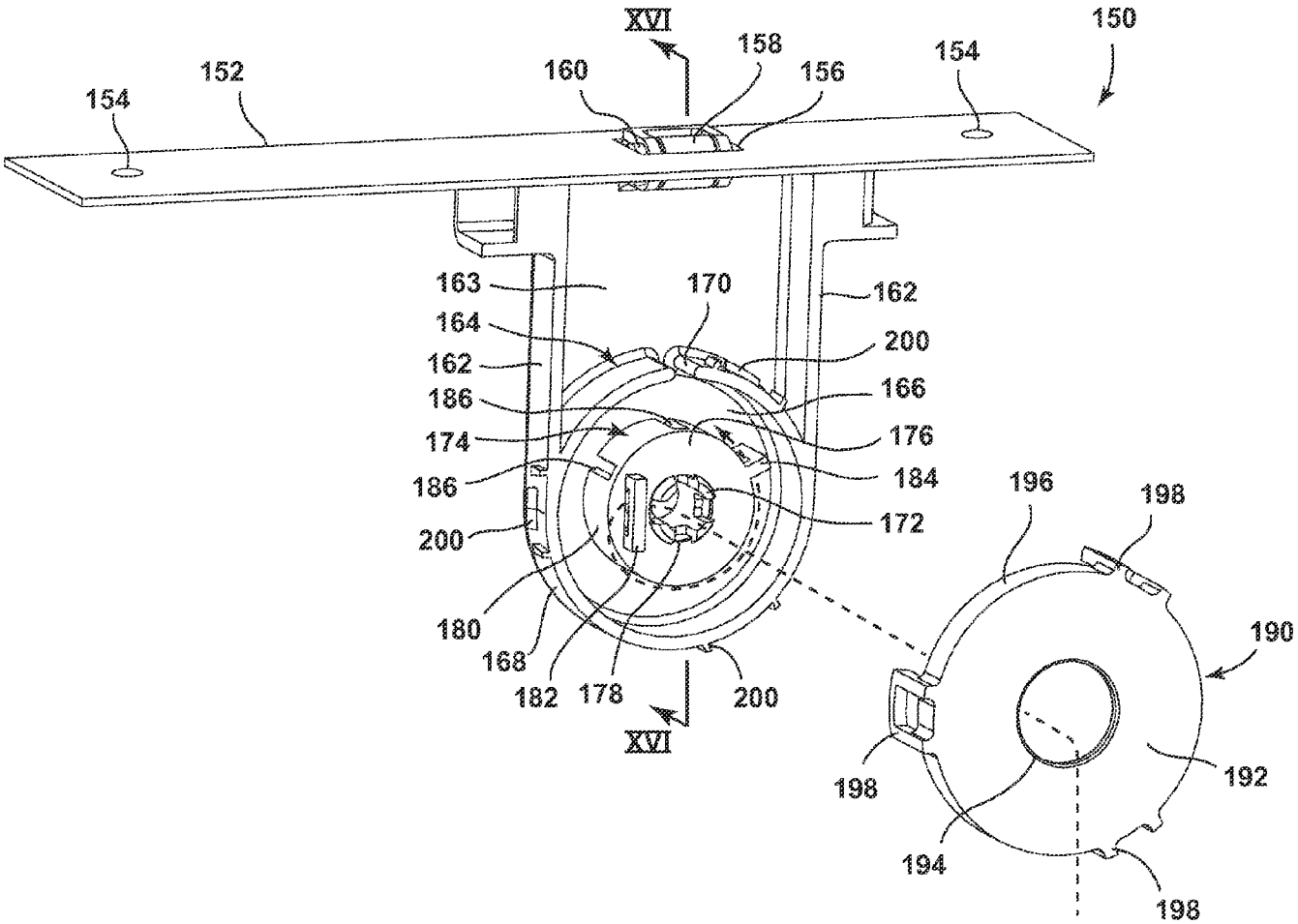
FIG. 15 is a partially exploded view of the cable storage system of FIG. 13.

Referring now to FIG. 15, which is a perspective view of the cable storage system 150 with the drum 174 assembled to the bushing 172 of the housing 164 and the enclosure cap 190 shown as exploded, the manner in which the lower cable portion 104 may enter the cable storage system 150 is indicated with a dashed arrow. In particular, the lower cable portion 104 enters the cable storage system 150 through the central opening 194 of the enclosure cap 190 and lies under the U-shaped projection 182 on the front wall 176 of the drum 174. The lower cable portion 104 then wraps around the drum 174 and lies under the L-shaped projection 182 on the peripheral wall 180 of the drum 174. As shown in the sectional view of FIG. 16, the lower cable portion 104 continues to wrap around the drum 174, except further wrappings of the lower cable portion 104 go over the projection 182 rather than under the projection 182, before leaving the housing 164 through the slit 170 and exiting the cable storage system 150 through the cable aperture 156 along the roller 158. The length of the lower cable portion 104 wrapped around the drum 174 is at least sufficient to accommodate sliding movement of the upper closure element 70 relative to the lower closure element 72 in the partial mode.

Figure 16:
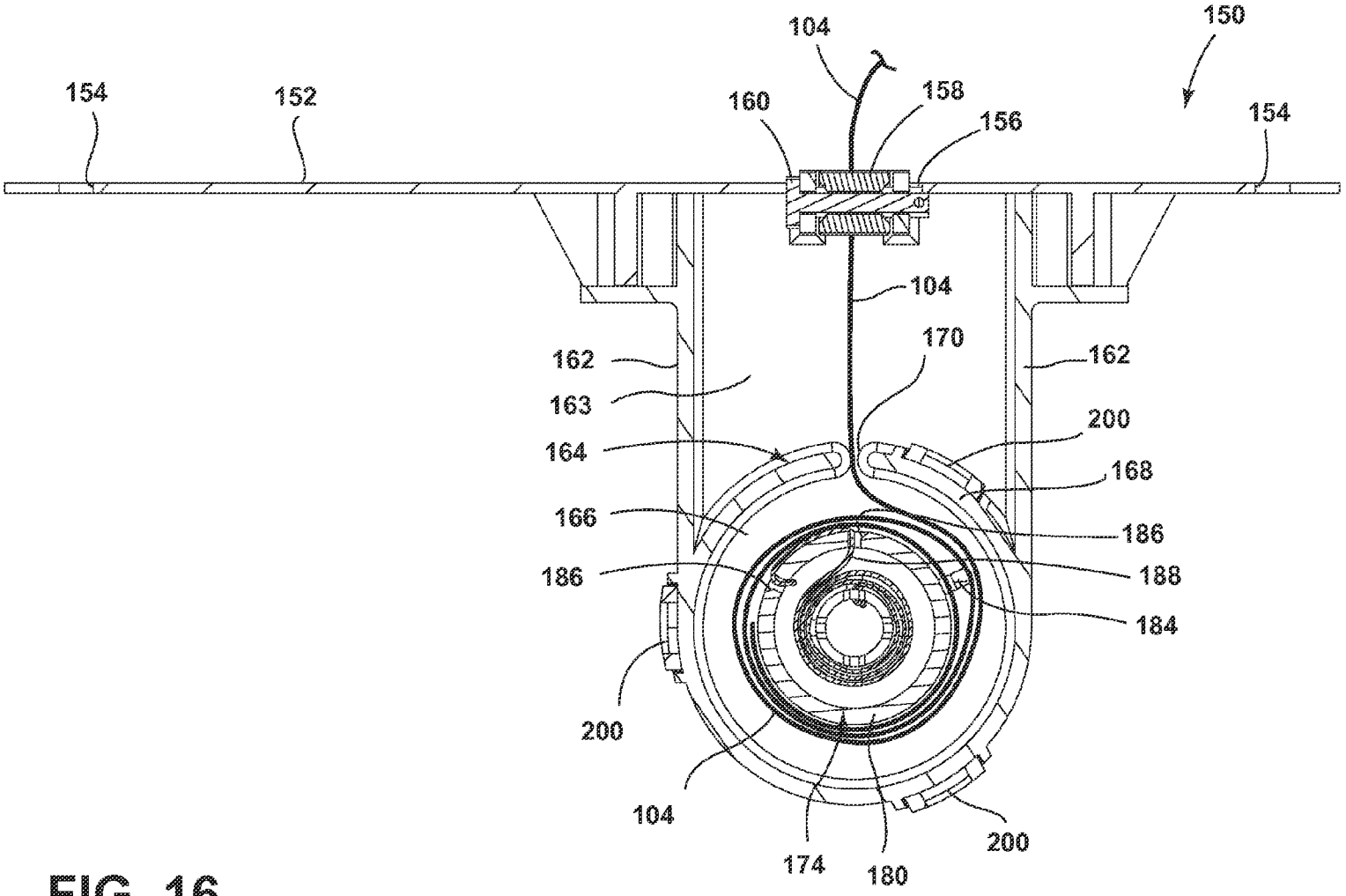
FIG. 16 is a sectional view taken along line XVI-XVI of FIG. 15.

FIG. 16 also illustrates the mounting of the biasing member 188 within the drum 174. The biasing member 188 in the form of the constant force coiled spring may be located in the space formed between the drum peripheral wall 180 and the housing barbed bushing 172. The biasing member 188 wraps around the bushing 172 and extends out of one the slits 186 in the peripheral wall 180 and back into the other of the slits 186 to secure the biasing member 188 to the drum 174.

Figure 17:
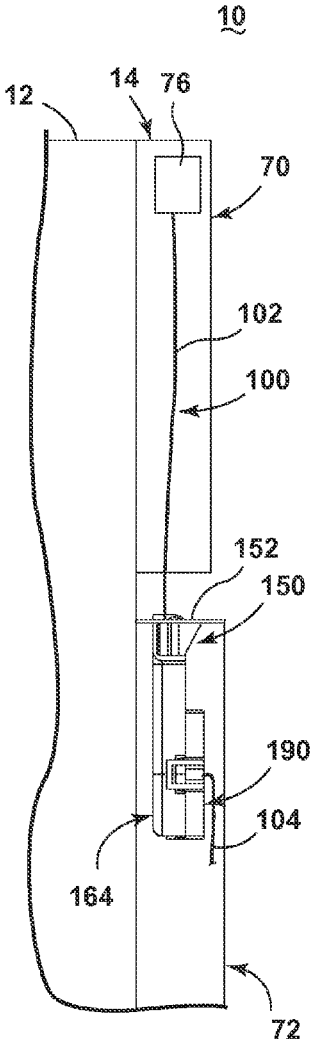
FIG. 17 is a schematic side view of the dishwasher of FIG. 1 with the closure element system in the full mode and closed condition showing the wired power and/or data communication system and the cable storage system of FIG. 13.

The condition of the cable storage system 150 in FIG. 16, wherein the biasing member 188 is tightly wound around the bushing 172, and the length of the lower cable portion 104 to accommodate movement of the upper closure element 70 is wound around the drum 174, corresponds to the situation where the closure element system 14 is in the full mode (or in the partial mode with the upper and lower closure elements 70, 72 vertically aligned), as illustrated schematically in FIG. 17. The length of the cable 100 between the cable storage system 150 and the user interface 76 may be selected so that at least some degree of slack is present in this part of the cable 100. In such a case, the biasing member 188 is fully wound and at rest, thus exerting essentially no rotational force on the drum 174. However, the length of the cable 100 between the cable storage system 150 and the user interface 76 may be selected so that no slack is present in this part of the cable 100, which results in a vertical force applied to the lower cable portion 104 in the direction out of the housing 164 and, thereby, a counterclockwise rotational force applied to the drum 174 and the biasing member 188. Because the biasing member 188 wants to return to its natural tightly wound condition, it resists the counterclockwise rotational force and puts the lower cable portion 104 under slight tension.

Figure 18:
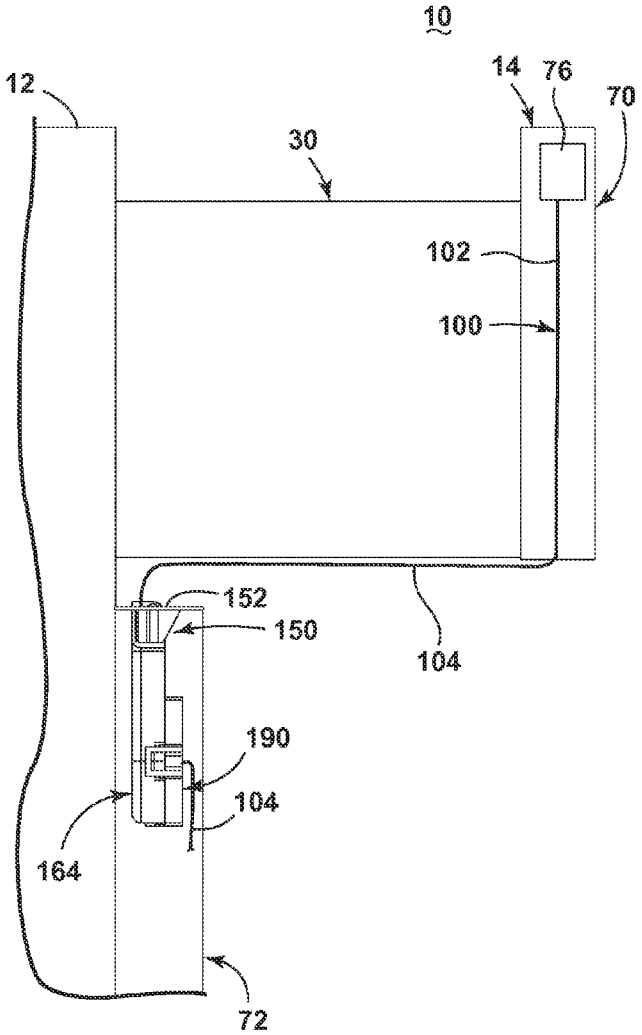
FIG. 18 is a schematic side view similar to FIG. 17 with the closure element system in the partial mode with the upper drawer slid forward of the dishwasher showing the wired power and/or data communication system and the cable storage system of FIG. 13.
Figure 19:
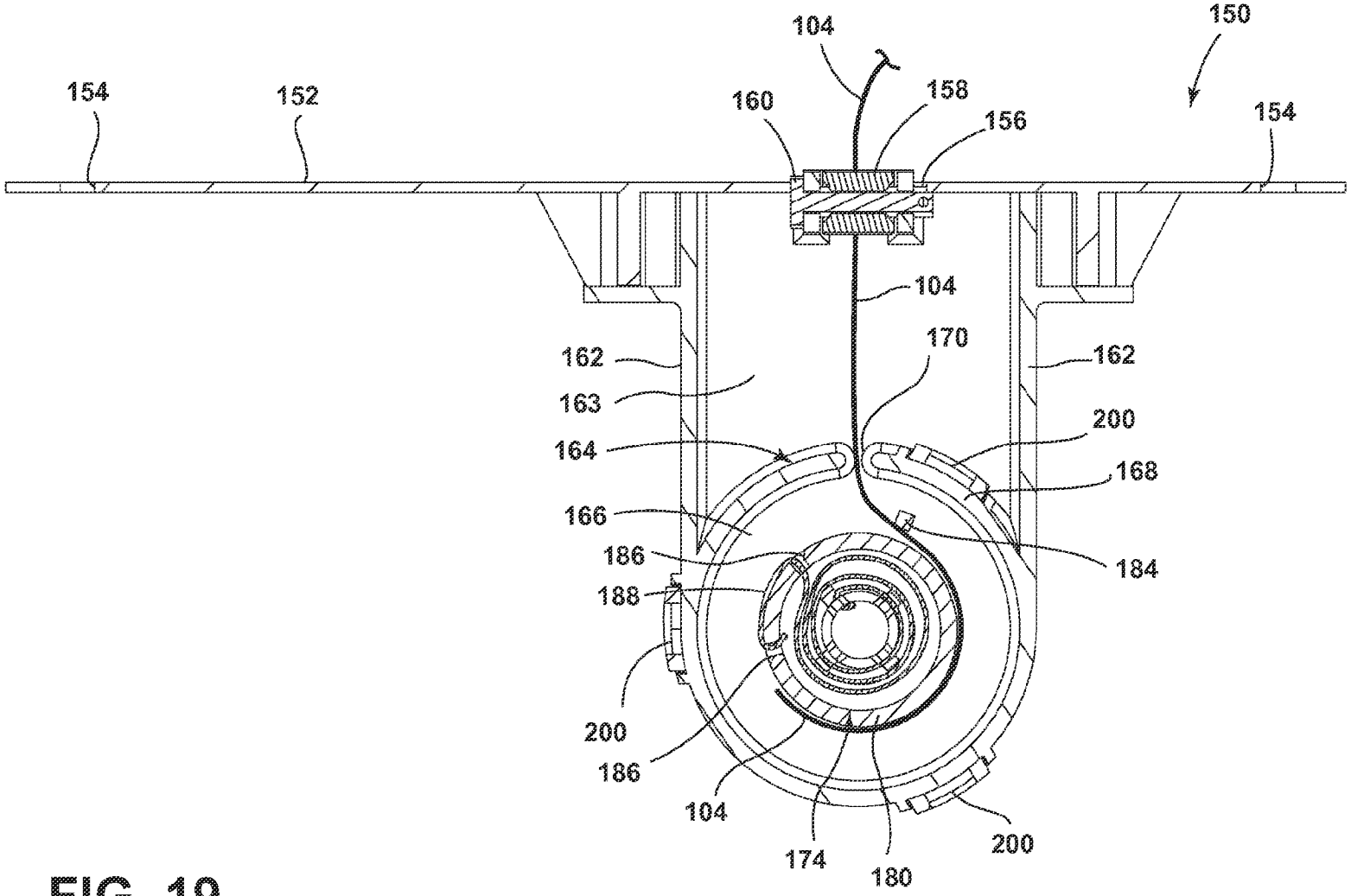
FIG. 19 is a sectional view similar to FIG. 16 with the cable storage system in the condition corresponding to FIG. 18.

When the closure element system 14 is in the partial mode, as the user slides the upper closure element 70 forward of the lower closure element 72, the lower cable portion 104 moves with the upper closure element 70, as depicted in FIG. 18. Particularly, the upper closure element 70 effectively pulls the lower cable portion 104 through the cable aperture 156 in the end cap 152, and the lower cable portion 104 rides along the roller 158 and assumes a generally horizontal configuration beneath the drawer 30. As shown in the sectional view of FIG. 19, the pulling of the lower cable portion 104 out of the cable storage system 150 results in counterclockwise rotation of the drum 174 and loosening or unwinding of the biasing member 188, which, again, resists the counterclockwise rotational force (i.e., the biasing member 188 applies a biasing force to the drum 174 in a clockwise retraction direction) and places the lower cable portion 104 under tension.

Returning to FIGS. 17 and 18, when the user slides the upper closure element 70 toward the lower closure element 72 to close the drawer 30, the lower cable element 104 retracts into the lower closure element 72 through the cable aperture 156. The lower cable portion 104 returns to the position shown in FIG. 17 upon complete closure of the drawer 30 with the upper closure element 70, with the cable storage system 150 returning to the condition in FIG. 16. In particular, as the lower cable portion 104 is fed back into the cable storage system 150, the biasing member 188 induces clockwise rotation of the drum 174, which wraps the retracting lower cable portion 104 around the drum 174.

Figure 20:
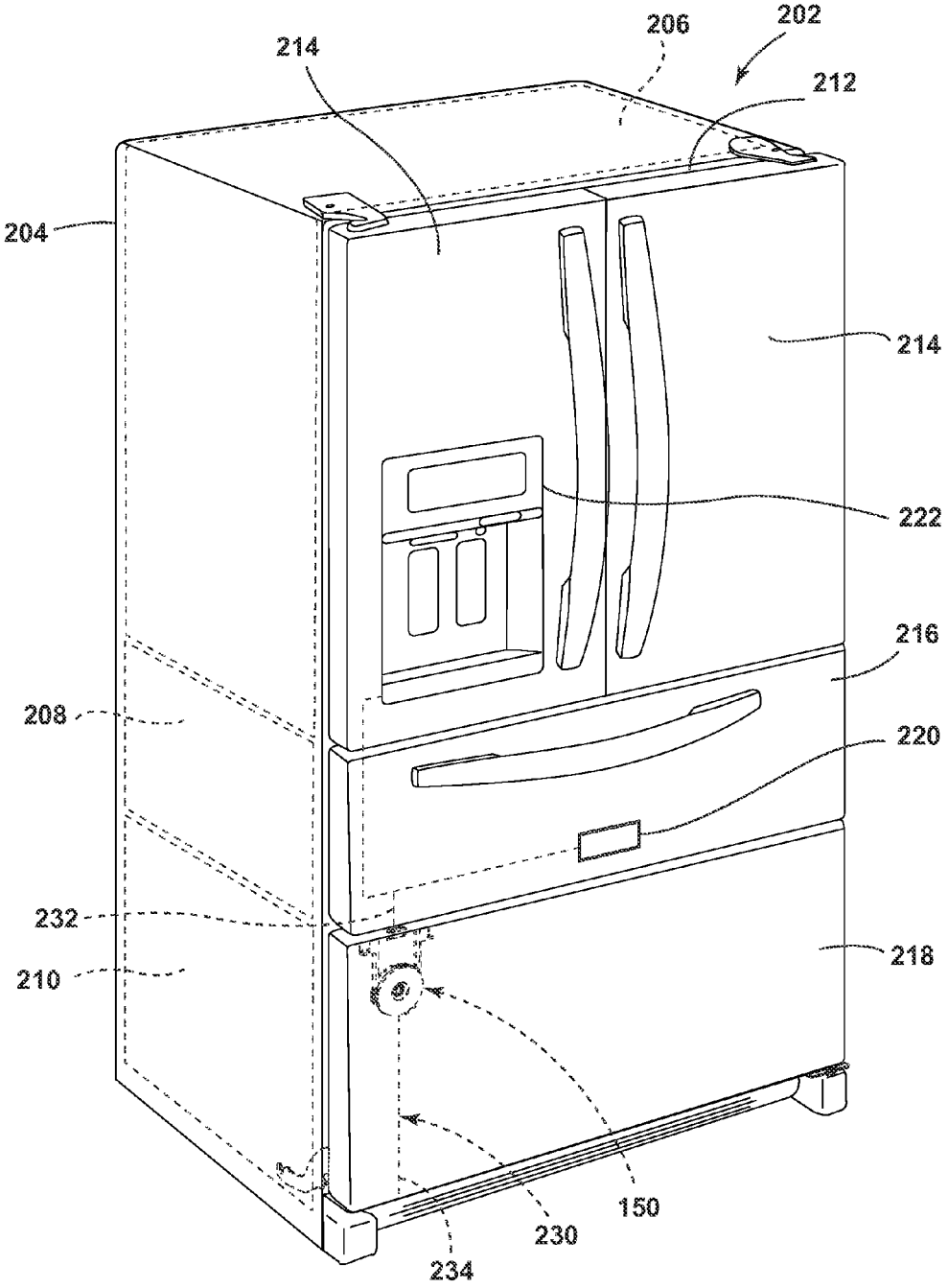
FIG. 20 is a schematic perspective view of an appliance in the form of a refrigerator/freezer according to one embodiment with a wired power and/or data communication system and a cable storage system according to one embodiment for a closure element system of the refrigerator/freezer.

The wired power and/or data communication system and the cable storage system may be incorporated into other types of appliances, including refrigerators, freezers, and other previously mentioned appliances. FIG. 20 schematically illustrates an example of incorporating the cable storage system 150 into a refrigerator/freezer 202. The exemplary refrigerator/freezer 202 has a cabinet 204 defining a refrigerating treating chamber 206, an upper freezing treating chamber 208, and a lower freezing treating chamber 210 that perform refrigerating and freezing cycles of operation on articles, such as food articles. The treating chambers 206, 208, 210 may be accessed through an access opening 212 defined by the front edges of the cabinet 204, and the access opening 212 may be selectively closed by a plurality of closure elements. For example, the refrigerator/freezer 202 may include a pair of refrigerator French doors 214 that pivot about vertical axes to selectively close the portion of the access opening 212 corresponding to the refrigerating treating chamber 206, an upper freezer closure element 216 that selectively closes the portion of the access opening 212 corresponding to the upper freezing treating chamber 208, and a lower freezer closure element 218 that selectively closes the portion of the access opening 212 corresponding to the lower freezing treating chamber 210. The upper and lower freezer closure elements 216, 218 may be configured to function in a manner similar to the upper and lower closure elements 70, 72 of the dishwasher 10 in the previous embodiments in that the upper freezer closure element 216 may couple or physically link with the lower freezer closure element 218 in a full mode for cooperative pivoting movement about a horizontal axis located at the bottom of the lower freezer closure element 218 to selectively close the portion of the access opening 212 corresponding to the upper and lower freezing treating chambers 208, 210, or the upper freezer closure element 216 may physically unlink from the lower freezer closure element 218 to form a drawer front for a drawer (not shown) in the upper freezer treating chamber 208 and selectively close the portion of the access opening corresponding to the upper freezing chamber 208 with movement independent of the lower freezer closure element 218. Additionally, one or more of the closure elements 214, 216, 218 may support an operative device, such as a user interface 220 on the upper freezer closure element 216 and a water and/or ice dispenser 222 on one of the refrigerator closure elements 214.

The operative device(s) may require power and/or data communication, which may be provided through a cable 230 having an upper cable portion 232 and a lower cable portion 234. The lower cable portion 234 may enter the lower freezer closure element 218 at the bottom edge in a conventional manner for hinged appliance doors. In the illustrated embodiment, the cable storage system 150 may be located in the lower freezer closure element 218 and mounted thereto at an upper edge of the lower freezer closure element 218 in a manner similar to that of previous embodiments. It is also feasible to employ the first embodiment cable storage system 110 or other cable storage systems with the refrigerator/freezer 202, and the second embodiment cable storage system 150 is shown with the refrigerator/freezer 202 for exemplary purposes. The cable storage system 150 may store a length of the lower cable portion 234 at least sufficient to accommodate sliding movement of the upper freezer closure element 216 relative to the lower freezer closure element 218 in the partial mode. The lower cable portion 234 may join with the upper cable portion 232 at the lower edge of the upper freezer closure element 216, and the upper cable portion 232 may be coupled to the user interface 220 and/or other operative device(s) on the upper freezer closure element 216. Further, the upper cable portion 232 may optionally be routed to one of the refrigerator closure elements 214 to the water and/or ice dispenser 222 and/or other operative device(s) on the refrigerator closure elements 214 to provide wired power and/or data communication.

In summary, the wired power and/or data communication system described above provides power and/or data communication to an operative device mounted on a closure element of an appliance. The cable for the wired connection may be routed through one closure element of the appliance to another closure element that supports the operative device. Optionally, the wired power and/or data communication system may include a system for storing a length of the cable that accommodates movement of one of the closure element systems, and, optionally, the storage system may place the cable under tension, as with the cable storage system 150. Alternatively, the appliance need not include a cable storage system such that the cable for the wired power and/or data communication system is simply routed through the closure elements without any specific device or system for storing the cable in one of the closure elements. Further, other types of cable storage systems that store the length of the cable that accommodates movement of one of the closure element systems other than the specific embodiments described herein may be employed with the closure elements of an appliance. Also, as mentioned above, the routing of a cable through one closure element to another closure element for coupling with an operative device may be employed with any type of appliance having two or more closure elements. The cable may also be routed through more than one closure element when the appliance has three or more closure elements, also using any suitable number of cable storage systems in the multiple closure elements. The operative device may be located on any one of the closure elements, and the cable may be routed through any suitable closure element, depending on the type and location of the closure elements and the operative device. The operative device(s) may be any suitable type of operative device, including the examples provided herein and devices not yet contemplated for use with appliances. The operative device may require any type of communication, including power and/or data and other types of wired communication, including those not yet contemplated for use with appliances.

Various modifications may be made to the closure element system 14, including the number, type, and orientation of the closure elements. Examples of modifications are described in the aforementioned and incorporated patent application.

While the invention has been specifically described in connection with certain specific embodiments thereof, it is to be understood that this is by way of illustration and not of limitation, and the scope of the appended claims should be construed as broadly as the prior art will permit.

What is claimed is:

1. An appliance conducting a useful cycle of operation on an article, the appliance comprising:

a treating chamber for receiving the article and having an access opening;

a first closure element selectively closing at least a first portion of the access opening;

a second closure element selectively closing at least a second portion of the access opening and movable relative to the first closure element between an open position in which the first closure element remains closed and a closed position;

an operative device coupled to the second closure element;

a cable providing at least one of electrical or data communication to the device, the cable routed through the first closure element to the second closure element and connected to the device on the second closure element; and a cable storage system, in the first closure element storing at least a portion of the length of the cable sufficient to accommodate movement of the second closure element relative to the first closure element, and including a cable carrier coupled to a portion of the cable located in the first closure element and movable with the portion of the cable in and out of the first closure element to accommodate movement of the second closure element relative to the first closure element;

wherein the cable provides the at least one of electrical or data communication to the device in both the open and closed positions of the second closure element.

2. The appliance of claim 1 wherein the portion of the cable located in the first closure element has a length sufficient to accommodate movement of the second closure element relative to the first closure element between the open and closed positions.

3. The appliance of claim 2 wherein the cable carrier comprises an articulated chain.

4. The appliance of claim 3 wherein the articulated chain is self-supporting such that it assumes a generally horizontal configuration under the drawer during movement of the second closure element relative to the first closure element.

5. The appliance of claim 3 wherein the cable storage system further comprises a weight coupled to the articulated chain to pull the articulated chain downward within the first closure element.

6. The appliance of claim 2, further comprising a drawer slidable relative to the treating chamber through the second portion of the access opening, and the second closure element forms a drawer front for the drawer.

7. The appliance of claim 6 wherein the cable enters the second closure element at a lower end of the second closure element.

8. The appliance of claim 7 wherein the cable exits the first closure element at an upper end of the first closure element.

9. The appliance of claim 6 wherein the appliance is a dishwasher further comprising a tub defining the treating chamber and the access opening.

10. The appliance of claim 9 wherein the first closure element is a door hingedly mounted to the tub and located below the second closure element.

11. The appliance of claim 10 wherein the cable is routed into the door at a lower end of the door and exits the door at an upper end of the door and is routed into the drawer front at a lower end of the drawer front for connection to the operative device.

12. The appliance of claim 2 wherein the appliance is a refrigerator further comprising a cabinet defining the treating chamber and the access opening.

13. The appliance of claim 12 wherein the first closure element is a door pivotably mounted to the cabinet, and the second closure element physically links with the first closure element for cooperative pivoting movement in a full mode and physically unlinks from the door for movement independent of the door in a partial mode.

14. The appliance of claim 1 wherein the operative device is a user interface.

* * * * *